US011892013B2

(12) United States Patent
Jayarathne et al.

(10) Patent No.: US 11,892,013 B2
(45) Date of Patent: Feb. 6, 2024

(54) BLOWER ASSEMBLY SYSTEMS AND METHODS

(71) Applicant: Johnson Controls Tyco IP Holdings LLP, Milwaukee, WI (US)

(72) Inventors: Madhuka Manuranga Jayarathne, Wichita, KS (US); Rohan Sham Bhuse, Wichita, KS (US); Lanson Delos Owen, II, Maize, KS (US); Austin Jacob Skaggs, Wichita, KS (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

(21) Appl. No.: 17/545,849

(22) Filed: Dec. 8, 2021

(65) Prior Publication Data

US 2022/0178385 A1 Jun. 9, 2022

Related U.S. Application Data

(60) Provisional application No. 63/122,849, filed on Dec. 8, 2020.

(51) Int. Cl.
*F24F 11/89* (2018.01)
*F24F 13/20* (2006.01)
(Continued)

(52) U.S. Cl.
CPC ..... *F04D 29/624* (2013.01); *F04D 17/08* (2013.01); *F04D 29/4206* (2013.01);
(Continued)

(58) Field of Classification Search
CPC ..... F24F 2013/205; F04D 29/624
See application file for complete search history.

(56) References Cited

U.S. PATENT DOCUMENTS 7,108,478 B2 * 9/2006 Hancock ..... F24F 1/0022 415/206
9,261,108 B2 2/2016 Van Deventer
(Continued)

FOREIGN PATENT DOCUMENTS

CN 109441887 A 3/2019
EP 2108897 A1 * 10/2009 ..... F24F 1/0007

OTHER PUBLICATIONS

Howtodoit, Air-Handler Fan Cleaning and Maintenance, Youtube—6:25 minutes, May 15, 2019, 3 pgs., https://www.youtube.com/watch?v=4cydNuaY2mI.

(Continued)

*Primary Examiner* — Steven S Anderson, II
(74) *Attorney, Agent, or Firm* — Fletcher Yoder, P.C.

(57) ABSTRACT

A blower assembly includes a blower shelf having a first support channel. The blower shelf includes a guide bracket coupled to the blower shelf to form a second support channel. A blower housing having a flange is configured to extend into the first support channel and the second support channel. The blower assembly includes a control mounting panel configured to couple to the blower housing and having a tab extending therefrom. The flange of the blower housing is configured to engage with the first support channel and the second support channel during transition of the blower housing along a first direction and into an installed configuration of the blower housing and during transition of the blower housing along a second direction, opposite the first direction, and into an uninstalled configuration of the blower housing. The tab abuts the guide bracket in the installed configuration.

20 Claims, 20 Drawing Sheets

(51) Int. Cl.

| | |
|---|---|
| ***F04D 17/16*** | (2006.01) |
| ***F04D 25/06*** | (2006.01) |
| ***F04D 29/58*** | (2006.01) |
| ***F04D 29/60*** | (2006.01) |
| ***F04D 29/62*** | (2006.01) |
| ***F04D 17/08*** | (2006.01) |
| ***F04D 29/42*** | (2006.01) |
| *F24F 7/007* | (2006.01) |
| *F24F 11/50* | (2018.01) |

(52) U.S. Cl.
CPC ..... *F24F 11/89* (2018.01); *F24F 13/20* (2013.01); *F24F 7/007* (2013.01); *F24F 11/50* (2018.01); *F24F 2013/205* (2013.01)

(56) References Cited

U.S. PATENT DOCUMENTS 9,759,446 B2 9/2017 Stewart et al.
10,006,661 B2 * 6/2018 Hanks ..... F24H 3/006
2012/0276836 A1 11/2012 Stewart et al.
2014/0056695 A1 * 2/2014 Locker, Jr. ..... F04D 29/626 415/126
2019/0212031 A1 7/2019 Stewart et al.

OTHER PUBLICATIONS

Anti DIY HVAC, Replacing X-13 Blower Motor in ICP Air Handler, YouTube—24:05 minutes, Sep. 24, 2019, 3 pgs., https://www.youtube.com/watch?v=-55iLKHEDOk.
Tomahawk DIY, How to Remove and Clean a Furnace Blower Wheel, YouTube—5:37 minutes, Sep. 29, 2015, 3 pgs., https://www.youtube.com/watch?v=MODIBXCGuRE.
12Voltvids, Carrier HVAC System Blower Fan Repair, YouTube—19:03 minutes, May 17, 2018, 4 pgs., https://www.youtube.com/watch?v=MfJRfRBTd_4.
RepairClinic.com, Payne Furnace Blower Motor Replacement #HC43AE134, YouTube—9:10 minutes, Mar. 11, 2015, 3 pgs.,https://www.youtube.com/watch?v=vuwOb3c5bik&list=RDCMUCGIWoFCiw_H5SW4sHWFzQSw&start_radio=1.

* cited by examiner

BLOWER ASSEMBLY SYSTEMS AND METHODS

CROSS-REFERENCE TO RELATED APPLICATIONS

This application claims priority from and the benefit of U.S. Provisional Application Ser. No. 63/122,849, entitled "AN ARRANGEMENT FOR MOUNTING BLOWER AND CONTROL PANEL OF AN HVAC DEVICE," filed Dec. 8, 2020, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are utilized in residential, commercial, and industrial environments to control environmental properties, such as temperature, humidity, and/or air quality, for occupants of the respective environments. The HVAC system may regulate the environmental properties through delivery of a conditioned air flow to the environment. For example, the HVAC system generally includes a fan or blower that is operable to direct an air flow across one or more heat exchange components of the HVAC system. As such, the blower may facilitate transfer of thermal energy between the heat exchange components and the air flow to generate the conditioned air flow for delivery to a suitable space within a building or other structure serviced by the HVAC system. Unfortunately, it may be arduous and cumbersome to access traditional blower systems for maintenance, inspection, or other purposes.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a blower assembly. The blower assembly includes a blower shelf having a first support channel. The blower shelf includes a guide bracket coupled to the blower shelf to form a second support channel, and a blower housing having a flange configured to extend into the first support channel and the second support channel. The blower assembly includes a control mounting panel configured to couple to the blower housing and having a tab extending therefrom. The flange of the blower housing is configured to engage with the first support channel and the second support channel during transition of the blower housing along a first direction and into an installed configuration of the blower housing and during transition of the blower housing along a second direction, opposite the first direction, and into an uninstalled configuration of the blower housing. The tab abuts the guide bracket in the installed configuration.

The present disclosure also relates to a blower assembly for a heating, ventilation, and air conditioning (HVAC) system. The blower assembly includes a blower shelf having a set of ledges forming first support channels. The blower assembly includes a set of guide brackets coupled to the blower shelf to form second support channels between a surface of the blower shelf and respective first flanges of the guide brackets. The blower assembly includes a blower sub-assembly having a blower housing and a control mounting panel configured to support control circuitry of a blower. The blower housing includes second flanges configured to engage with the first support channels and the second support channels. The second flanges are configured to translate along the first support channels and the second support channels in a first direction during installation of the blower sub-assembly with the blower shelf. The control mounting panel is configured to be secured to the guide brackets in an installed configuration of the blower sub-assembly.

The present disclosure also relates to a heating, ventilation, and/or air conditioning (HVAC) system that includes an enclosure configured to house a blower. The HVAC system includes a blower shelf coupled to the enclosure, where the blower shelf has a first support channel. The HVAC system includes a guide bracket coupled to the blower shelf to form a second support channel between the guide bracket and the blower shelf. The HVAC system includes a blower sub-assembly having a blower housing of the blower, where the blower housing includes a flange extending therefrom. The blower sub-assembly includes a control mounting panel coupled to the blower housing and supporting control circuitry of the blower mounted to the control mounting panel. The flange of the blower housing is configured to translate along the first support channel and the second support channel in a first direction to transition the blower sub-assembly to an installed configuration within the enclosure. The flange of the blower housing is configured to translate along the first support channel and the second support channel in a second direction, opposite the first direction, to transition the blower sub-assembly to an uninstalled configuration.

BRIEF DESCRIPTION OF THE DRAWINGS

Various aspects of this disclosure may be better understood upon reading the following detailed description and upon reference to the drawings in which.

DETAILED DESCRIPTION

Figure 1:
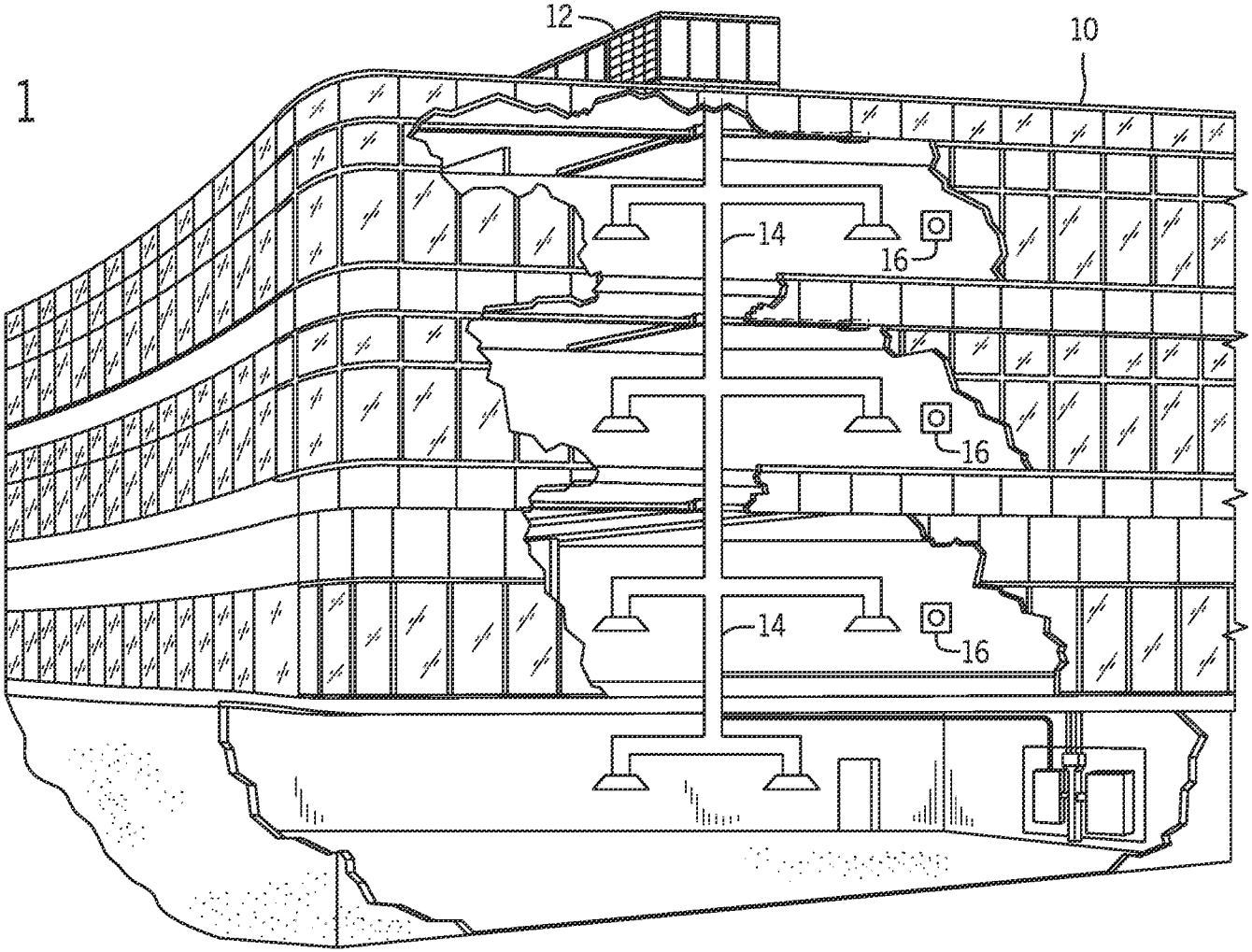
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as parallel and perpendicular, should not be rigidly interpreted in a mathematical sense, but should instead be interpreted as one of ordinary skill in the art would interpret such terms. For example, one of ordinary skill in the art would understand that two lines that are substantially parallel to each other are parallel to a substantial degree, but may have minor deviation from exactly parallel.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system typically includes heat exchangers, such as a condenser and an evaporator, which are fluidly coupled to one another via one or more conduits of a refrigerant loop or circuit. A compressor may be used to circulate the refrigerant through the conduits and other components of the refrigerant circuit (e.g., an expansion device) and, thus, enables the transfer of thermal energy between components of the refrigerant circuit (e.g., between the condenser and the evaporator) and one or more thermal loads (e.g., an environmental air flow, a supply air flow). Additionally or alternatively, the HVAC system may include a heat pump having a first heat exchanger (e.g., a heating and/or cooling coil), a second heat exchanger (e.g., a heating and/or cooling coil), and a pump (e.g., compressor) configured to circulate the working fluid (e.g., water, brine, refrigerant) between the first and second heat exchangers to enable heat transfer between the thermal loads and an ambient environment (e.g., the atmosphere), for example. Further, in some embodiments the HVAC system may include a furnace system configured to provide heating. For example, the furnace system may include a plurality of heat pipes configured to receive combustion products from a burner assembly and/or may include an electric heating coil configured to facilitate transfer of thermal energy to an air flow directed across the heat pipes and/or electric heating coil.

Generally, the HVAC system includes a blower (e.g., a fan) that is configured to direct air across heat exchange components of the HVAC system and/or along an air distribution system (e.g., ductwork) of the HVAC system. Unfortunately, traditional blowers are often difficult to access and frequently involve full or partial extraction and/or removal of the blowers from an enclosure (e.g., a furnace enclosure, a duct, etc.) of the HVAC system, which may be arduous and time consuming. For example, traditional blowers may be coupled to an enclosure or other support structure of the HVAC system using a plurality of fasteners (e.g., screws) that are located in areas or regions of the enclosure that may be difficult or infeasible for a service technician to access without first removing and/or disassembling other components of the HVAC system that may be positioned adjacent to the blower. Moreover, removal of conventional blowers may involve cumbersome removal of control circuitry and wiring associated with the blower to provide sufficient space for subsequent extraction of the blower from the enclosure that houses the blower. As such, it may be difficult for a user (e.g., a service technician) to perform maintenance, inspection, or other tasks on the blower upon installation of the blower in the enclosure of the HVAC system.

It is now recognized that maintenance, installation, removal, and other operations on the blower may be facilitated and improved by enabling removal and/or replacement of the blower without disassembly and/or removal of other HVAC system components that may be adjacent to the blower. Moreover, it is now recognized that enabling removal of control circuitry of the blower together with a housing of the blower, without involving separate removal of the control circuitry independent of the housing, may expedite and reduce a complexity of removal of the blower and the control circuitry from the HVAC system. Facilitating maintenance, installation, removal, and other operations on the blower may reduce a time period between non-operational periods of the HVAC system (e.g., such as while maintenance is performed on the blower), which may improve an overall efficiency of the HVAC system and/or may reduce costs associated with HVAC system maintenance.

Accordingly, embodiments of the present disclosure are directed toward a blower assembly that is configured to facilitate removal and/or extraction of a blower from an enclosure (e.g., a blower enclosure) of the HVAC system. The blower assembly includes a shelf (e.g., a blower shelf) that may be coupled to or otherwise positioned within a blower enclosure of the HVAC system, such as an enclosure of a furnace, for example. A set of first support channels may be formed in a body of the blower shelf. The blower shelf may also include a plurality of guide brackets coupled thereto, and the guide brackets may form a set of second support channels between respective flanges of the guide brackets and a surface of the blower shelf. The first and second support channels may be configured to receive respective flanges of a housing (e.g., a blower housing) of the blower. To this end, engagement between the first and second support channels and the flanges of the blower housing may enable translation of the blower along the blower shelf in a first direction toward an installed configuration and, alternatively, to translate along a second direction (e.g., opposite to the first direction) toward an uninstalled configuration. That is, the blower assembly may facilitate rapid transitioning of the blower between the installed configuration (e.g., an installed configuration within the blower enclosure) and the uninstalled configuration (e.g., an unassembled, removed, or extracted configuration of the blower with respect to the blower enclosure) via translation of the blower along the blower shelf and without involving disassembly of other HVAC components that may be positioned adjacent to the blower in the blower enclosure. Moreover, as discussed below, control circuitry of the blower may be coupled to the blower housing and, thus, be configured to translate with the blower between the installed and uninstalled configurations in accordance with the techniques discussed herein. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
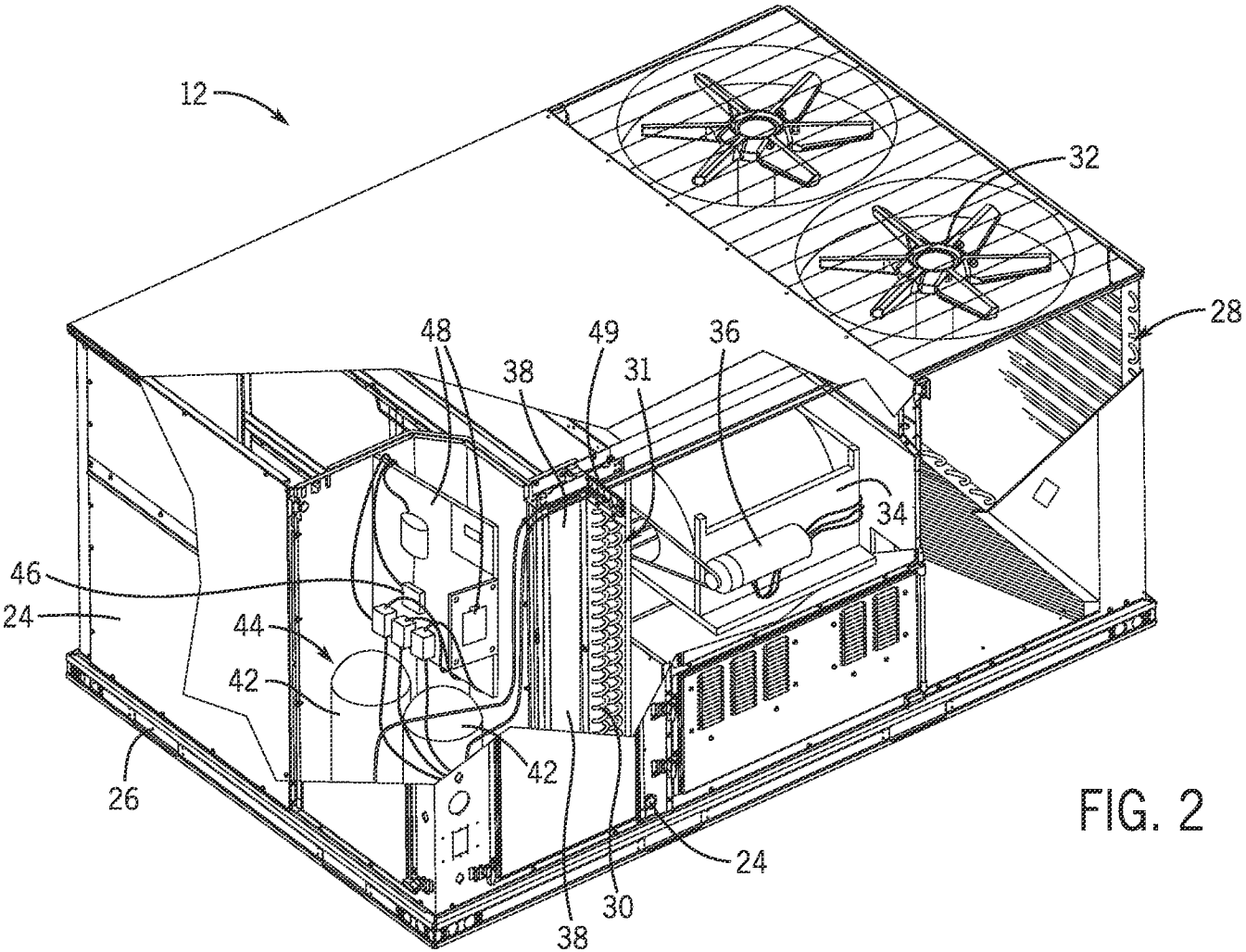
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
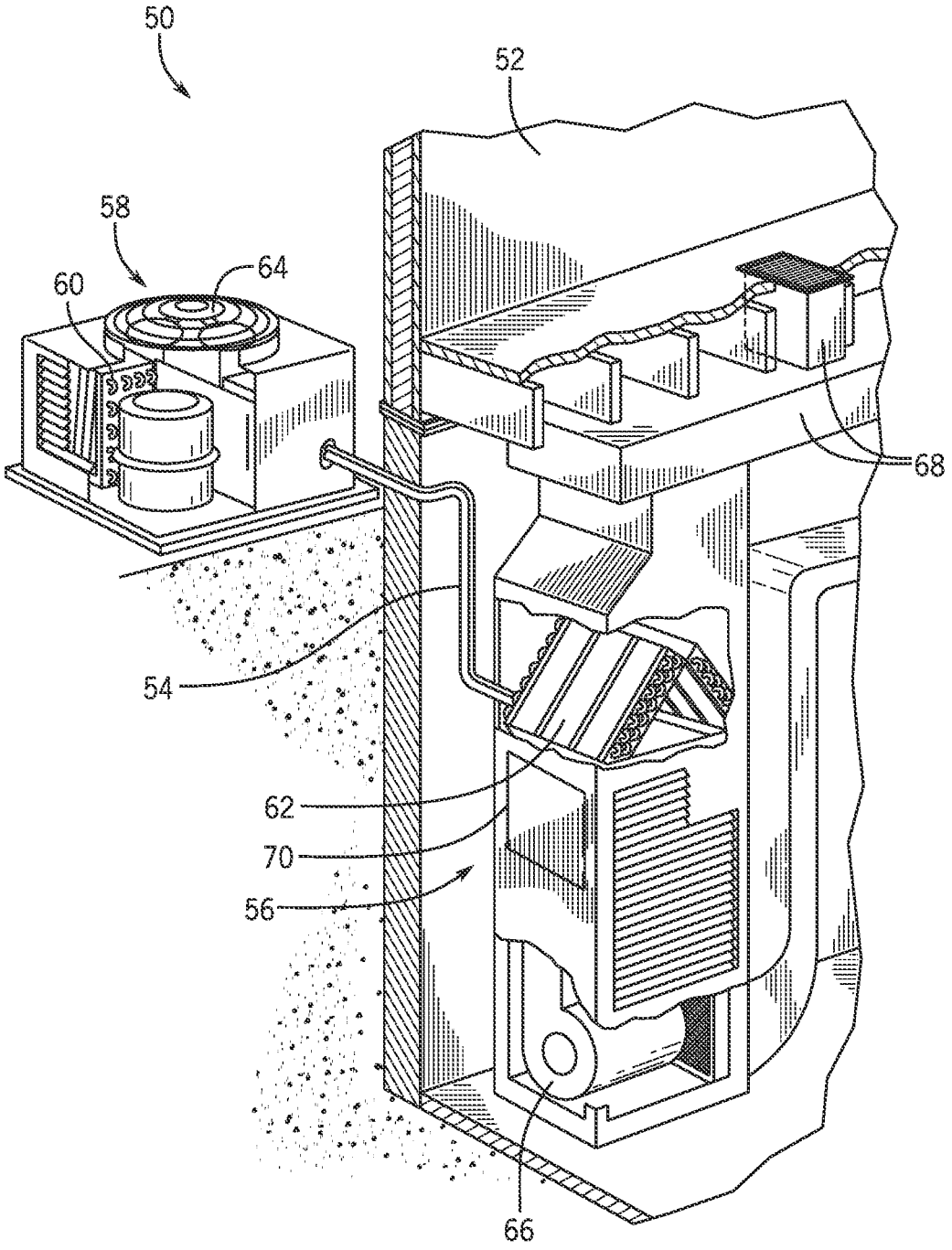
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
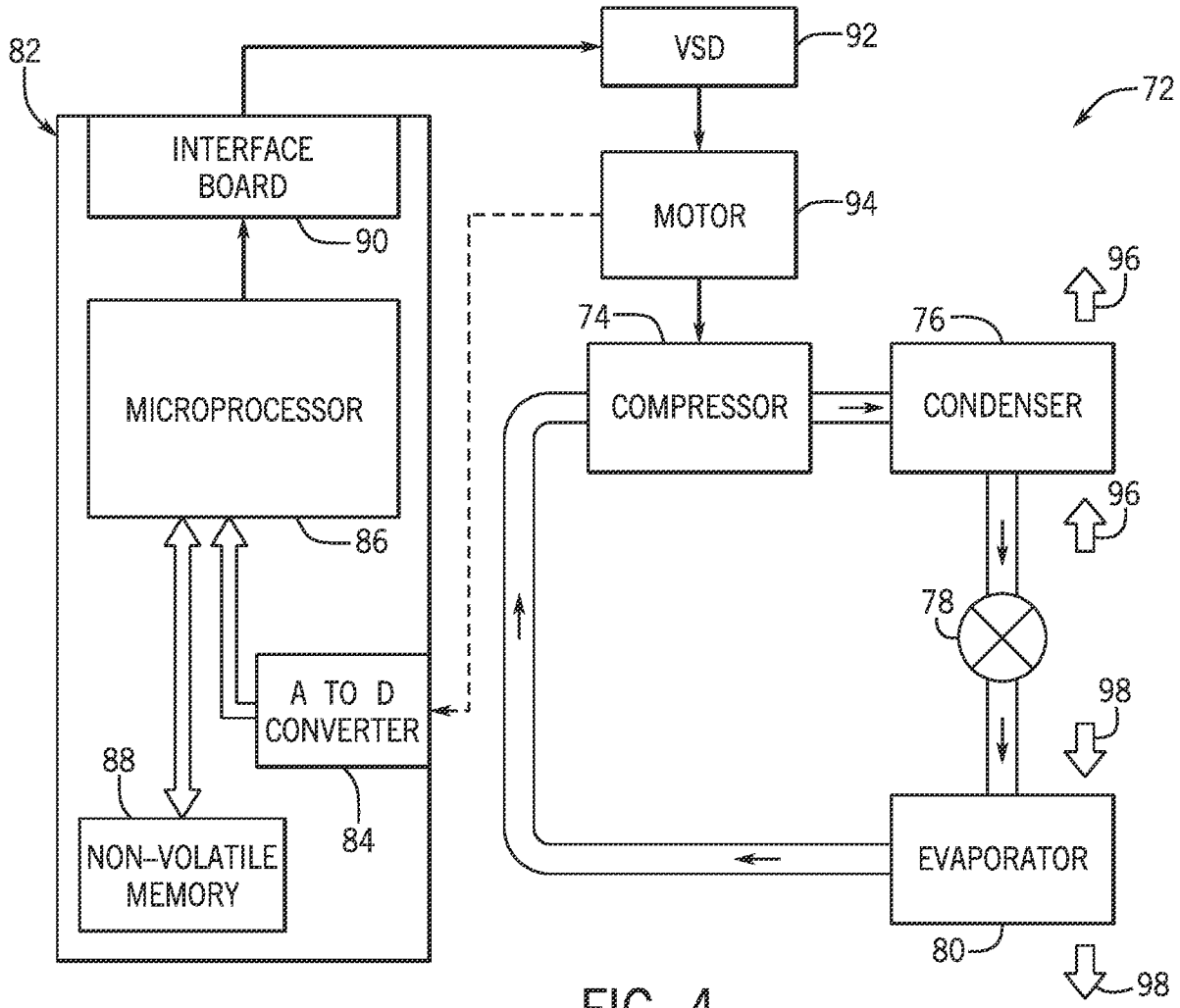
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
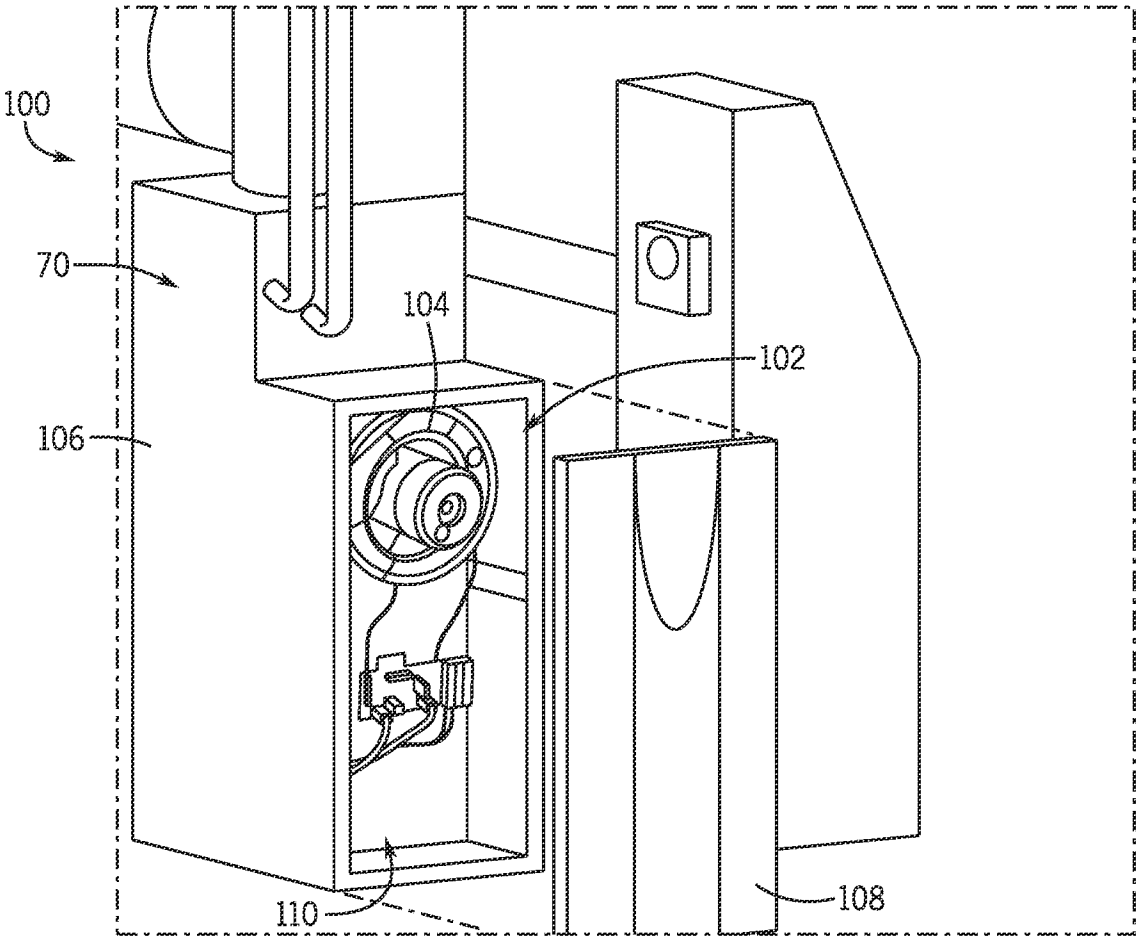
FIG. 5 is a perspective view of an embodiment of a portion of an HVAC system having a blower assembly, in accordance with an aspect of the present disclosure.

FIG. 5 is a perspective view of an embodiment of a portion of an HVAC system 100 that includes the furnace system 70. The furnace system 70 includes a blower assembly 102 in accordance with present embodiments. The blower assembly 102 includes a blower 104, such as the blower 66, which may be configured to direct air across heat exchanger components (e.g., heat transfer tubes) of the furnace system 70 and through ductwork (e.g., the ductwork 68) of a building or other structure serviced by the HVAC system 100. In the illustrated embodiment, the furnace system 70 includes an enclosure 106 (e.g., an air handler enclosure) configured to house components of the furnace system 70, such as the blower 104 and the heat transfer tubes of the furnace system 70. For clarity, the enclosure 106 may also be referred to herein as a "blower enclosure." The enclosure 106 may include a door 108 or panel that may be moveably (e.g., pivotably, removably, slidingly) coupled to a remainder of the enclosure 106 to expose or occlude an opening 110 of the enclosure 106. As discussed in detail herein, the blower assembly 102 may facilitate installation of the blower 104 into and removal of the blower 104 from the enclosure 106 via the opening 110, for example. That is, the blower assembly 102 may facilitate transitioning the blower 104 to an installed configuration or an assembled configuration within the enclosure 106 and to an uninstalled configuration or a removed configuration from the enclosure 106, substantially without involving disassembly of other HVAC components that may be positioned within the enclosure 106 and/or adjacent to the blower 104. It should be appreciated that the presently disclosed techniques may be incorporated with other systems or components including the blower assembly 102, such as an air handling unit, an indoor unit, a rooftop unit, or other HVAC system.

Figure 6:
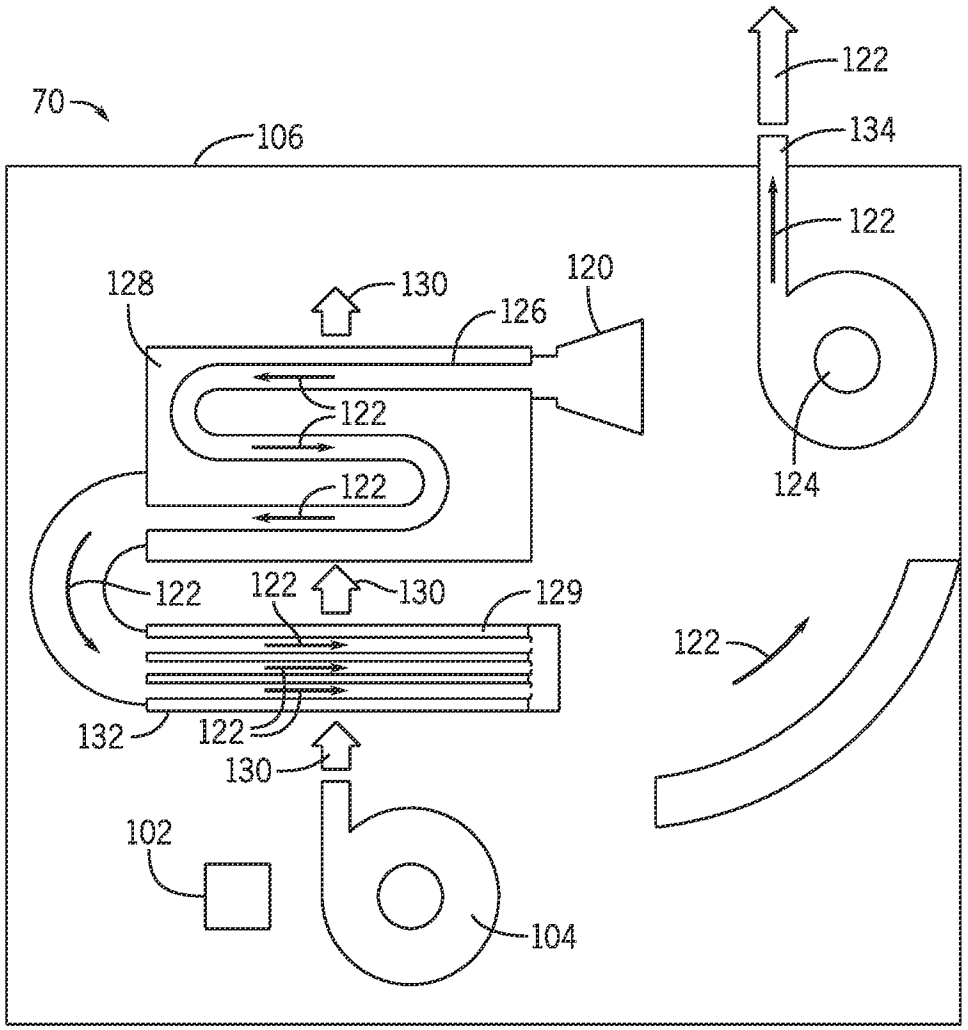
FIG. 6 is a schematic of an embodiment of a furnace system having a blower assembly, in accordance with an aspect of the present disclosure.

FIG. 6 is a schematic of an embodiment of the furnace system 70 having the blower assembly 102. In the illustrated embodiment, the furnace system 70 includes a burner 120 (e.g., one or more burner assemblies) configured to combust a fuel to generate combustion products 122. A draft inducer blower 124 is configured to draw the combustion products 122 through one or more tubes 126 of a first heat exchanger 128 and through one or more additional tubes 129 of a second heat exchanger 132 (e.g., a condensing heat exchanger). The blower 104 is configured to direct a flow of supply air 130 across the tubes 126 of the first heat exchanger 128 and the additional tubes 129 of the second heat exchanger 132 to enable the supply air 130 to absorb thermal energy from the heated combustion products 122 directed through the first and second heat exchangers 128, 132. As such, the blower 104 may deliver heated supply air 130 to a space within a building or other structure serviced by the HVAC system 100. The draft inducer blower 124 may discharge the combustion products 122 form the furnace system 70 via an exhaust vent 134. It should be understood that, in some embodiments, the first heat exchanger 128 or the second heat exchanger 132 may be omitted from the furnace system 70. Indeed, many different embodiments of the furnace system 70 are envisioned, and the illustrated embodiment of the furnace system 70 of FIG. 6 is merely intended to provide context for the following discussion. The furnace system 70 includes the blower assembly 102 configured to enable improved installation and removal of the blower 104 from the enclosure 106 of the furnace system 70 in accordance with the techniques discussed herein.

Although the blower assembly 102 is discussed in the context of implementation in the furnace system 70 throughout the following discussion, it should be appreciated that the blower assembly 102 may be implemented to facilitate installation and removal of the blower 104 or of another fan from any suitable enclosure, system, or space. That is, the blower assembly 102 may be used in accordance with the presently disclosed techniques to facilitate installation or removal of a blower, fan, or other flow generating device from a heat exchanger assembly (e.g., an evaporator assembly, a condenser assembly), a duct, a refrigeration unit, another HVAC system housing or enclosure, and so forth.

Figure 7:
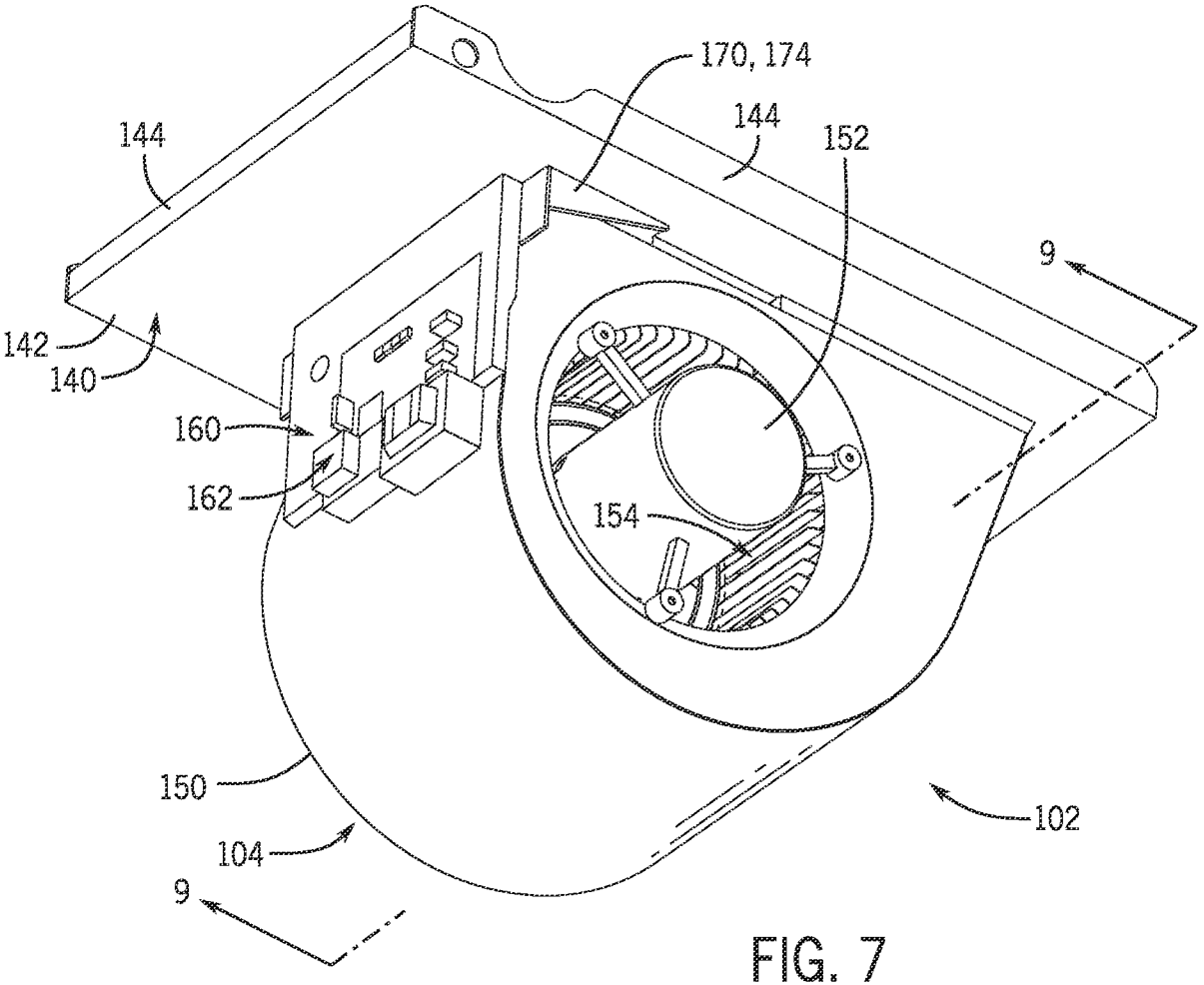
FIG. 7 is a perspective view of an embodiment of a blower assembly in an installed configuration, in accordance with an aspect of the present disclosure.

With the foregoing in mind, FIG. 7 is a perspective view of an embodiment of the blower assembly 102. The blower assembly 102 includes a blower shelf 140 that may be configured to fixedly couple (e.g., via fasteners) to a portion of the enclosure 106, for example. In the illustrated embodiment, the blower shelf 140 includes a main surface 142, also referred to herein as a sliding surface or main panel, and a plurality of walls 144 (e.g., flanges) that may extend from a perimeter of the main surface 142. In some embodiments, the walls 144 may facilitate coupling the blower shelf 140 to a suitable portion of the enclosure 106 and/or add structural rigidity and/or stiffness to the blower shelf 140.

Figure 8:
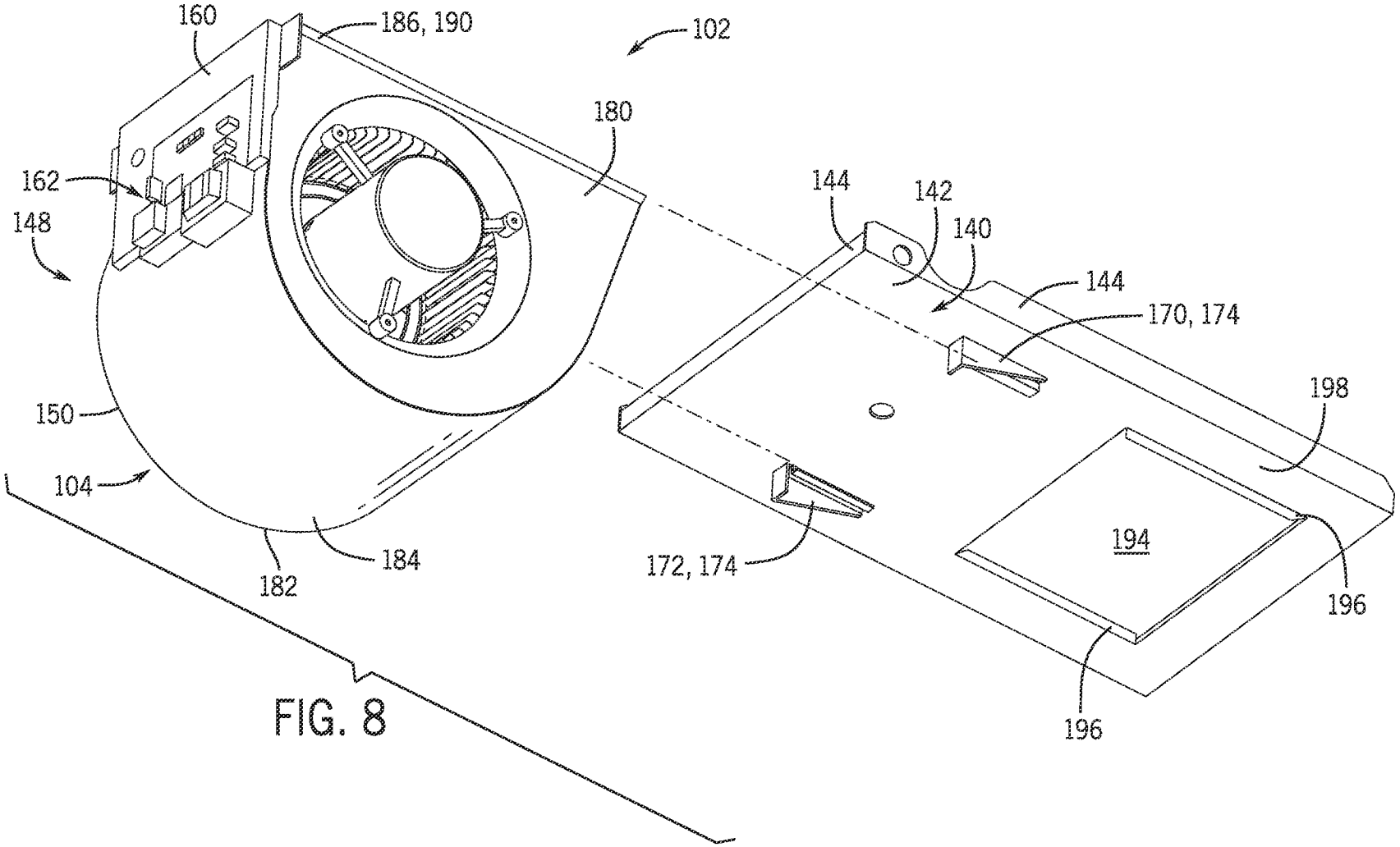
FIG. 8 is a perspective view of an embodiment of a blower assembly in an uninstalled configuration, in accordance with an aspect of the present disclosure.

As discussed in detail herein, the blower 104 is configured to engage with and translate along the main surface 142 of the blower shelf 140 to facilitate transition of the blower 104 between an installed configuration 146 on the blower shelf 140 and an uninstalled configuration 148 (see FIG. 8). The installed configuration 146 of the blower 104 on the blower shelf 140 may also be referred to herein as an assembled configuration of the blower assembly 102. Moreover, the uninstalled configuration 148 of the blower 104 (e.g., in which the blower 104 is fully or partially detached from the blower shelf 140) may also be referred to herein as an unassembled configuration of the blower assembly 102.

In the illustrated embodiment of FIG. 7, the blower 104 includes a blower housing 150 and a motor 152 (e.g., a blower motor) coupled to the blower housing 150. The motor 152 is configured to drive rotation of a fan wheel 154 of the blower 104. Via rotation of the fan wheel 154, the motor 152 may cause the blower 104 to intake an air flow via an inlet 156 of the blower housing 150 and discharge the air flow via an outlet port 158 (see FIG. 16) of the blower housing 150.

In some embodiments, blower assembly 102 includes a control mounting panel 160 (e.g., a controller mounting panel) that is coupled or mounted to the blower housing 150 (e.g., via fasteners, adhesives, or a metallurgical process, such as welding or brazing). The control mounting panel 160 may be configured to support control circuitry 162 of the blower 104, which may be electrically and/or communicatively coupled to the motor 152. The control circuitry 162 may be configured to control or otherwise adjust operation of the blower 104 (e.g., instruct the motor 152 increase or decrease in speed, etc.). As discussed below, the control mounting panel 160 may be configured to move (e.g., translate) with the blower housing 150, relative to the blower shelf 140, during transition of the blower 104 from the installed configuration 146 on the blower shelf 140 to the uninstalled configuration 148, and vice versa. As discussed in detail below, the blower assembly 102 may further include a first guide bracket 170 and a second guide bracket 172 (see FIG. 8) that may be coupled to the blower shelf 140 and configured to support the blower 104 on (e.g., against, suspended from, etc.) the blower shelf 140, as well as to guide transition of the blower 104 between the installed and uninstalled configurations 146, 148. The first and second guide brackets 170, 172 may collectively be referred to herein as guide brackets 174.

FIG. 8 is a perspective view of an embodiment of the blower assembly 102 in the unassembled configuration (e.g., in which the blower 104 is in the uninstalled configuration 148). The blower housing 150 includes a first side wall 180, a second side wall 182, and a wrap 184 that extends between the first side wall 180 and the second side wall 182. The blower housing 150 may include a first flange 186 that extends from and generally cross-wise to the first side wall 180, and may include a second flange 188 (see FIG. 9) that extends from and generally cross-wise to the second side wall 182. The first flange 186 and the second flange 188 will be collectively referred to herein as flanges 190 of the blower housing 150. As discussed below, the flanges 190 may be configured to engage with the blower shelf 140 and the guide brackets 174 to support the blower 104 on (e.g., against, suspended from, etc.) the blower shelf 140 and to facilitate transition of the blower 104 between the installed and uninstalled configurations 146, 148.

The blower shelf 140 may include an outlet opening 194 formed therein, where the outlet opening 194 is configured to align with the outlet port 158 of the blower housing 150 in the installed configuration 146 of the blower 104 with the blower shelf 140. As such, in the installed configuration 146, the blower 104 may direct an air flow discharged from the outlet port 158 of the blower 104 through the outlet opening 194 of the blower shelf 140 and toward another portion of the HVAC system 100.

Figure 9:
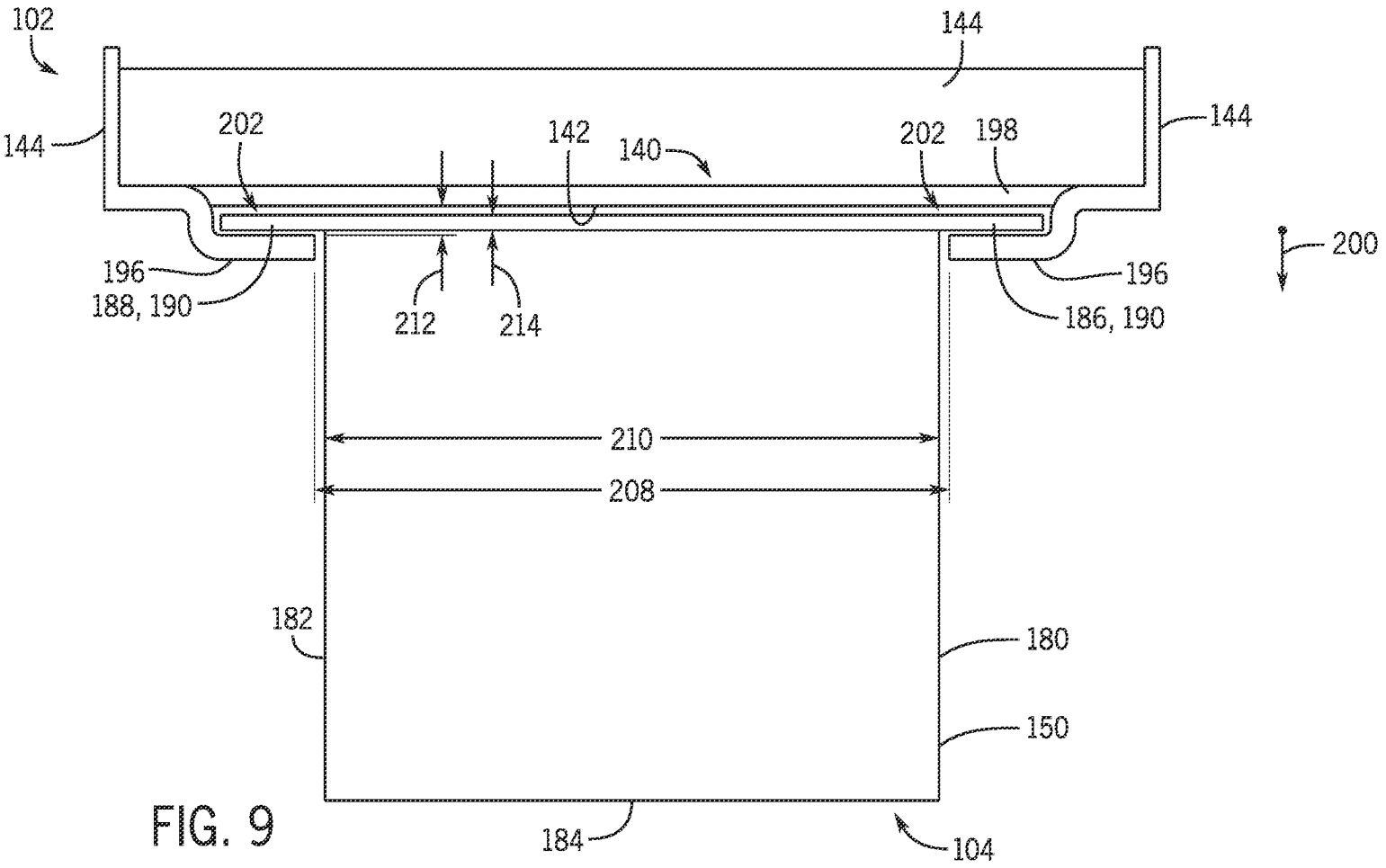
FIG. 9 is a cross-sectional view of an embodiment of a blower assembly, taken along line 9-9 of FIG. 7, in accordance with an aspect of the present disclosure.

The blower shelf 140 may include a set of ledges 196 (e.g., flanges) that extend from a body portion 198 of the blower shelf 140 and into the outlet opening 194. To better illustrate the ledges 196 and to facilitate the following discussion, FIG. 9 is a cross-sectional view of the blower shelf 140 taken along line 9-9 of FIG. 7. As shown in the illustrated embodiment of FIG. 9, the ledges 196 may extend from the body portion 198 in a first direction 200, away from the main surface 142, and also extend toward one another. In this way, the ledges 196 may form a set of primary support channels 202 (e.g., first support channels) that are configured to receive and accommodate the flanges 190 of the blower housing 150 to enable support of the blower 104 via engagement between the ledges 196 and the flanges 190. In particular, the ledges 196 may form a first support channel 202 configured to receive and support the first flange 186 of the blower housing 150 and a second support channel 202 configured to receive and support the second flange 188 of the blower housing 150. In some embodiments, a first dimension 208 between distal ends of the ledges 196 may be approximately equal to or slightly greater than a width 210 of the blower housing 150 (e.g., a dimension between the first side wall 180 and the second side wall 182 of the blower housing 150). Respective second dimensions 212 between the main surface 142 of the blower shelf 140 and each ledge 196 of the blower shelf 140 may be approximately equal to or slightly greater than respective thicknesses 214 of the flanges 190.

In some embodiments, the ledges 196 may be formed integrally with the blower shelf 140. For example, the blower shelf 140 may be formed from a single piece of material (e.g., sheet metal) that is stamped, bent, cut, or otherwise deformed or shaped to include the features of the blower shelf 140 discussed herein. In other embodiments, the ledges 196 may include components that are separate from the blower shelf 140 and are coupled to the blower shelf 140 via fasteners, bonding glue, or a metallurgical process, such as welding or brazing.

Figure 10:
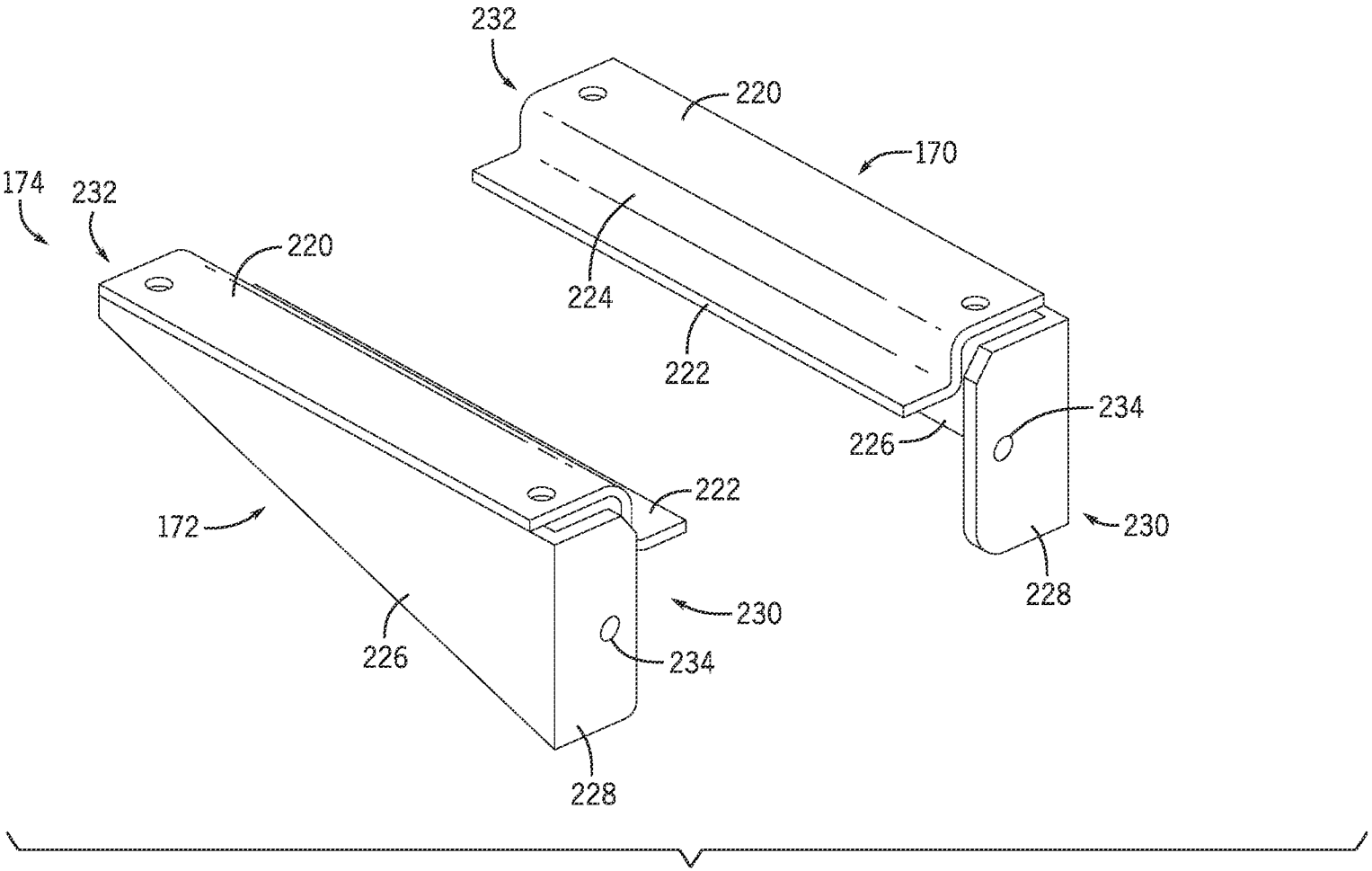
FIG. 10 is a perspective view of an embodiment of guide brackets of a blower assembly, in accordance with an aspect of the present disclosure.

FIG. 10 is a perspective view of the guide brackets 174 of the blower assembly 102. In the illustrated embodiment, the guide brackets 174 each include a mounting flange 220, a guide flange 222, a web 224 extending between the mounting flange 220 and the guide flange 222, a side flange 226, and an abutment tab 228. In some embodiments, the web 224 may extend generally co-planar with the side flange 226. The abutment tab 228 may extend cross-wise to the side flange 226 and the mounting flange 220. In some embodiments, the guide brackets 174 may each be formed from a single piece of material (e.g., sheet metal) that is stamped, bent, or otherwise deformed to include the features of the guide brackets 174 discussed herein. As discussed below, the guide brackets 174 may, in an engaged configuration (e.g., coupled configuration) with the blower shelf 140, form a set of secondary support channels (e.g., second support channels) that are configured to support the blower housing 150 in addition to, for example, the primary support channels 202 of the blower shelf 140. In some embodiments, a height dimension of the web 224 (e.g., a dimension extending between the mounting flange 220 and the guide flange 222) may decrease from respective first end portions 230 of the guide brackets 174 toward respective second end portions 232 of the guide brackets 174. In this way, the guide flanges 222 may be angled relative to the main surface 142 of the blower shelf 140 in an installed configuration of the guide brackets 174 with the blower shelf 140, which may enable the guide brackets 174 to force the blower housing 150 toward the main surface 142 during progressive engagement of the blower housing 150 with the guide brackets 174 during installation of the blower 104. Moreover, as discussed below, the abutment tabs 228 may each include one or more apertures 234 formed therein that facilitate coupling the guide brackets 174 to the control mounting panel 160 and/or the blower housing 150 in the installed configuration 146 of the blower 104 with the blower shelf 140.

Figure 11:
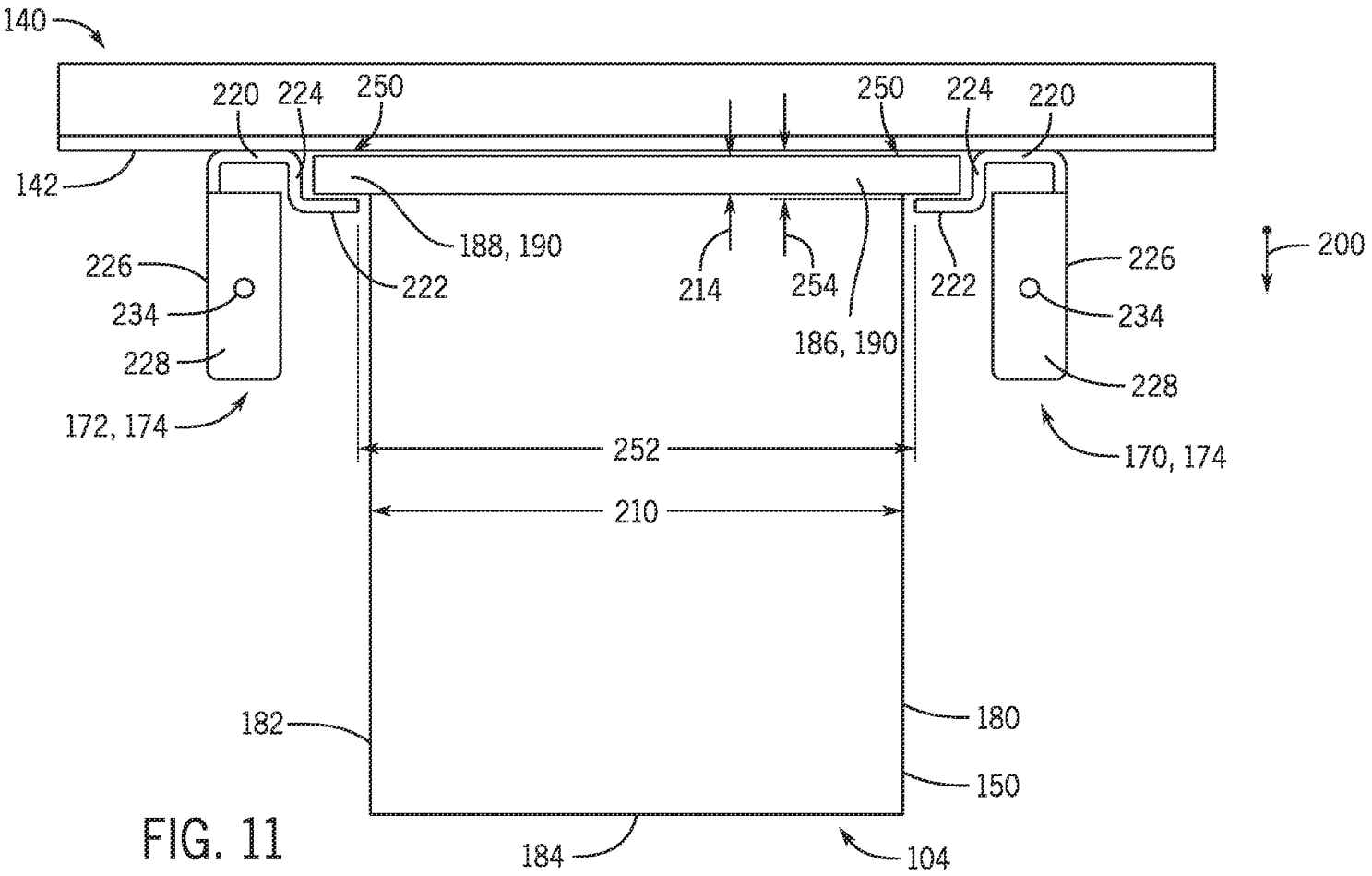
FIG. 11 is a front view of an embodiment of a blower assembly in an installed configuration, in accordance with an aspect of the present disclosure.

To better illustrate the engagement between the guide brackets 174 and the blower shelf 140, FIG. 11 is a front view of an embodiment of the guide brackets 174 in an engaged configuration with the blower shelf 140. In the engaged configuration, the mounting flanges 220 of the guide brackets 174 may be coupled to the main surface 142 of the blower shelf 140 via fasteners, adhesives, or another suitable technique. As shown in the illustrated embodiment, the webs 224 may extend in the first direction 200, away from the main surface 142. That is, the webs 224 may extend generally cross-wise from the main surface 142. The guide flanges 222 may be offset from the main surface 142 and extend toward one another to form a set of secondary support channels 250 (e.g., second support channels 250) that extend between the main surface 142 and respective surfaces of guide flanges 222. The secondary support channels 250 are configured to receive and support the flanges 190 of the blower housing 150. In particular, the guide flanges 222 may form a first secondary support channel 250 configured to receive and support the first flange 186 of the blower housing 150 and a second secondary support channel 250 configured to receive and support the second flange 188 of the blower housing 150.

In some embodiments, a third dimension 252 extending between distal ends of the guide flanges 222 may be approximately equal to or slightly greater than the width 210 of the blower housing 150. Respective fourth dimensions 254 extending between the main surface 142 and corresponding surfaces of the guide flanges 222 may be approximately equal to or slightly greater than the respective thicknesses 214 of the flanges 190. It should be appreciated that, due to a decrease in a height dimension of the webs 224 from the respective first end portions 230 to the respective second end portions 232 of the guide brackets 174, the fourth dimensions 254 between the main surface 142 of the blower shelf 140 and surfaces of the guide flanges 222 may correspondingly decrease in a direction extending from the first end portion 230 of the guide brackets 174 to the second end portions 232 of the guide brackets 174. That is, respective height dimensions of the secondary support channels 250 may be non-uniform and decrease in a direction extending from the first end portion 230 of the guide brackets 174 to the second end portions 232 of the guide brackets 174.

Figure 12:
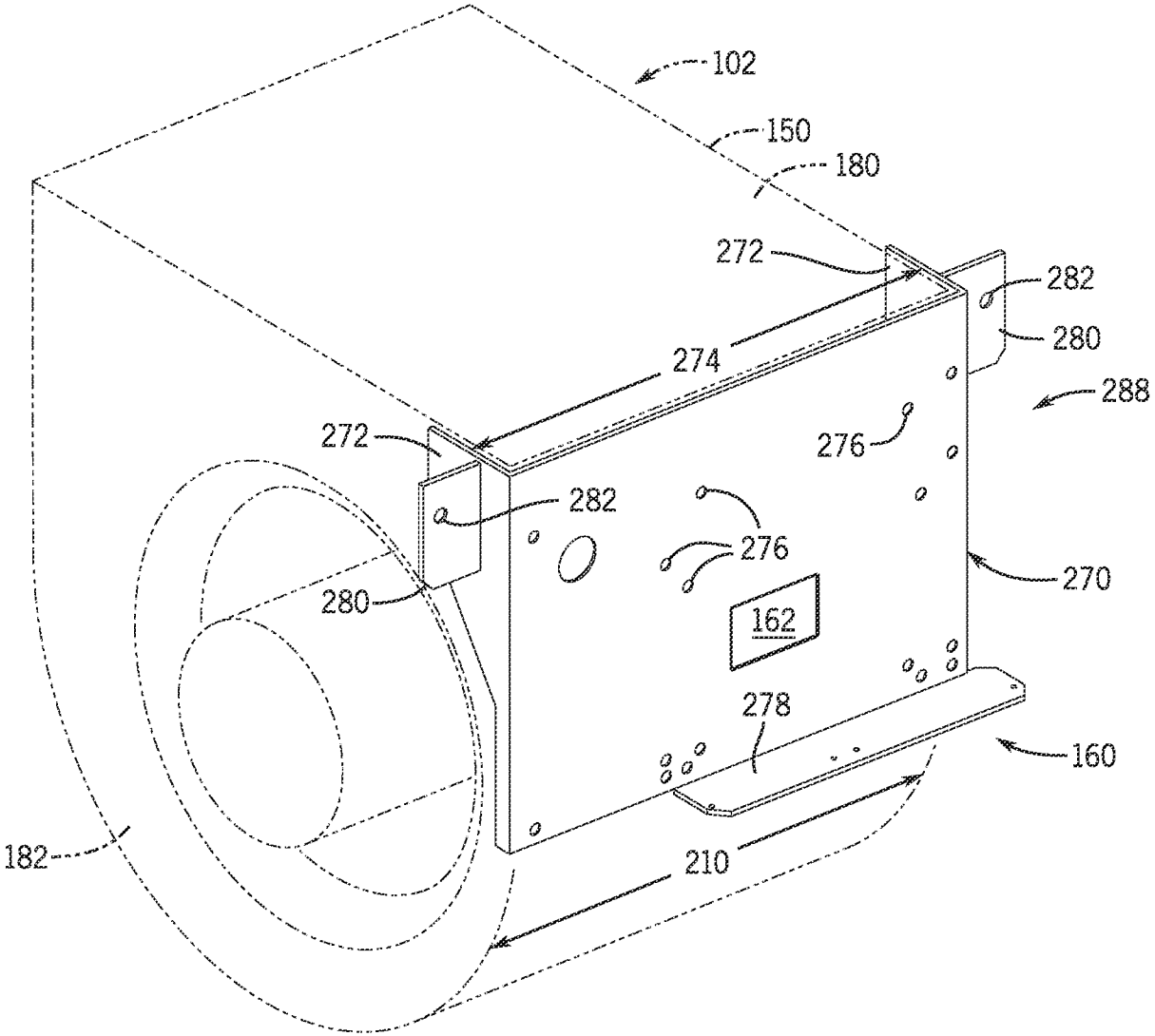
FIG. 12 is a perspective view of an embodiment of a portion of a blower assembly, in accordance with an aspect of the present disclosure.

FIG. 12 is a perspective view of an embodiment of the control mounting panel 160. In the illustrated embodiment, the control mounting panel 160 includes a central panel 270 (e.g., main panel) extending between a set of attachment flanges 272. In some embodiments, the attachment flanges 272 may extend generally cross-wise from or orthogonal to the central panel 270. In certain embodiments, a width dimension 274 extending between the attachment flanges 272 may be approximately equal to or slightly greater than the width 210 of the blower housing 150. As such, to install the control mounting panel 160 on the blower housing 150, the blower housing 150 may be slid between the attachment flanges 272 and coupled to the attachment flanges 272, for example. That is, the first side wall 180 of the blower housing 150 may be coupled to one of the attachment flanges 272, and the second side wall 182 of the blower housing 150 may be coupled to a remaining one of the attachment flanges 272. The attachment flanges 272 may be coupled to the blower housing 150 using fasteners (e.g., rivets, screws), adhesives, and/or a metallurgical process. In some embodiments, the central panel 270 may be coupled to, for example, the wrap 184, in addition to, or in lieu of, the coupling of the attachment flanges 272 to the first and second side walls 180, 182.

The control mounting panel 160 may include a plurality of apertures 276 formed therein that may facilitate mounting the control circuitry 162 to the control mounting panel 160 using suitable fasteners, for example. In certain embodiments, the control mounting panel 160 may include one or more auxiliary flanges 278 that facilitate coupling additional control circuitry components to the control mounting panel 160. In the illustrated embodiment, the control mounting panel 160 includes a set of tabs 280 that may extend from and generally cross-wise to the attachment flanges 272. The tabs 280 may each include one or more apertures 282 formed therein that, as discussed below, are configured to facilitate coupling of the tabs 280 to the abutment tabs 228 of the guide brackets 174 to retain the blower 104 on (e.g., against) the blower shelf 140 in the installed configuration 146. In certain embodiments, the tabs 280 may extend from another suitable portion of the control mounting panel 160, such as from the central panel 270. In such embodiments, one or both of the attachment flanges 272 may be omitted from the control mounting panel 160. Throughout the following discussion, the blower 104, the control mounting panel 160, and the control circuitry 162 may collectively be referred to as a blower sub-assembly 288 of the blower assembly 102.

Figure 13:
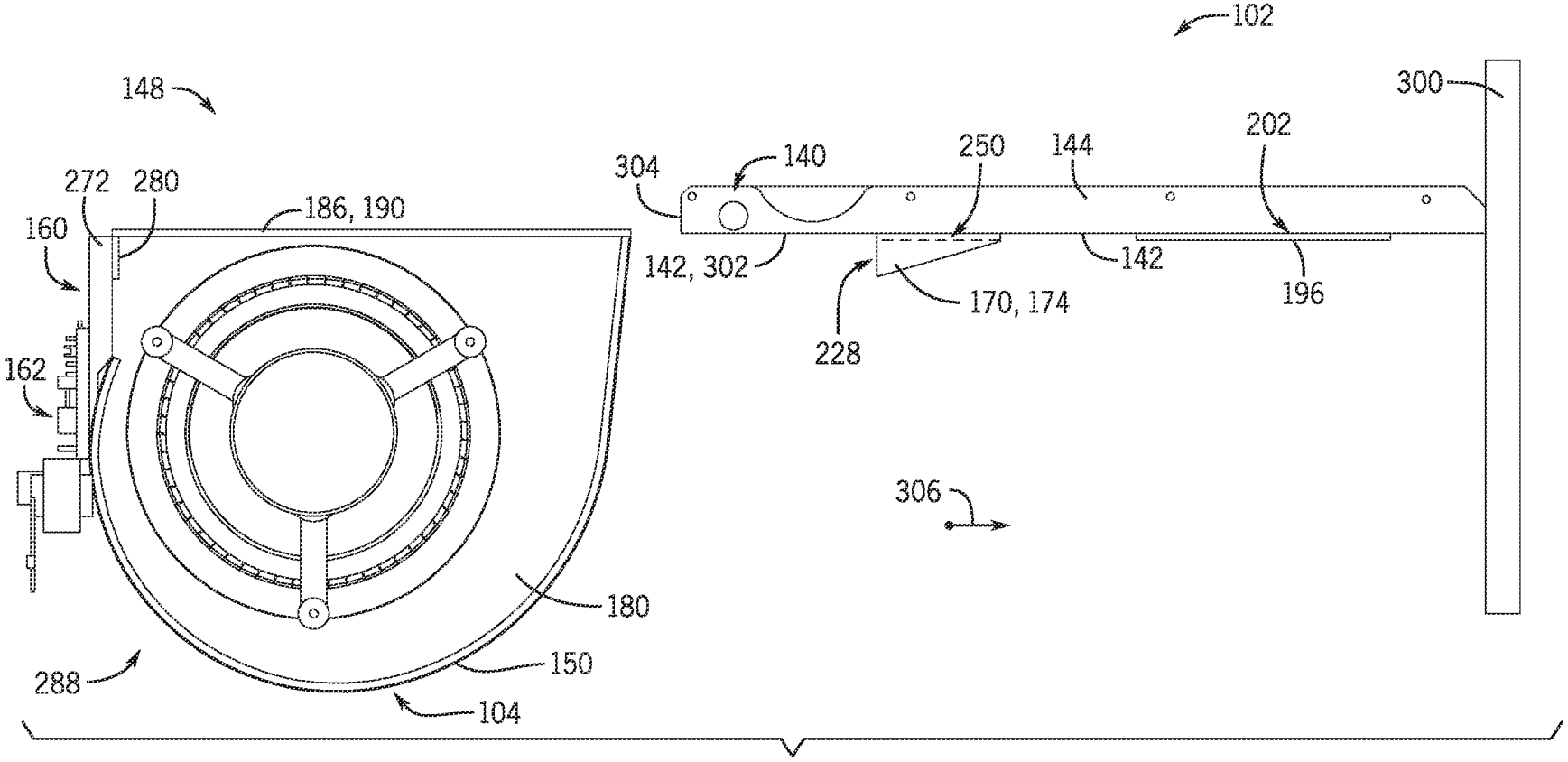
FIG. 13 is an elevation view of an embodiment of a blower assembly in an uninstalled configuration, in accordance with an aspect of the present disclosure.

FIG. 13 is an elevation view of an embodiment of the blower assembly 102 in the unassembled configuration, in which the blower 104 is in the uninstalled configuration 148, and where the blower sub-assembly 288 may be decoupled from the blower shelf 140. That is, in the illustrated embodiment of FIG. 13, the blower sub-assembly 288 is in an uninstalled configuration, in which the blower sub-assembly 288 may be detached from the blower shelf 140 (e.g., the flanges 190 of the blower housing 150 may not be engaged with the primary support channels 202 and/or the secondary support channels 250). As noted above, the blower shelf 140 may be coupled to, for example, a portion 300 of the enclosure 106, such a side panels of the enclosure 106 and/or a support structure (e.g., frame rails) within the enclosure 106. Accordingly, in some embodiments, the blower sub-assembly 288 may be removed or extracted from the enclosure 106 in the uninstalled configuration 148.

To transition the blower sub-assembly 288 from the uninstalled configuration to an installed configuration on the blower shelf 140, a user (e.g., a service technician) of the blower assembly 102 may align the flanges 190 of the blower housing 150 with the main surface 142 of the blower shelf 140. For example, the user may position the blower housing 150 such that the flanges 190 contact a portion 302 of the main surface 142 that is positioned between a distal end 304 of the blower shelf 140 and the guide brackets 174. Next, the user may slide the blower sub-assembly 288 (e.g., along the main surface 142) in a first sliding direction 306 toward the guide brackets 174 to enable the flanges 190 of the blower housing 150 to extend into the secondary support channels 250 formed between the main surface 142 of the blower shelf 140 and the guide flanges 222 of the guide brackets 174. Upon engagement of the flanges 190 with the secondary support channels 250, the user may continue to direct the blower sub-assembly 288 in the first sliding direction 306 to engage the flanges 190 with the primary support channels 202 formed in the blower shelf 140. As such, it should be understood that the flanges 190 of the blower housing 150 may translate along the primary support channels 202 and the secondary support channels 250 in the first sliding direction 306. The user may continue to slide the blower sub-assembly 288 in the first sliding direction 306 until the tabs 280 of the control mounting panel 160 engage (e.g., contact) the abutment tabs 228 of the guide brackets 174.

Figure 14:
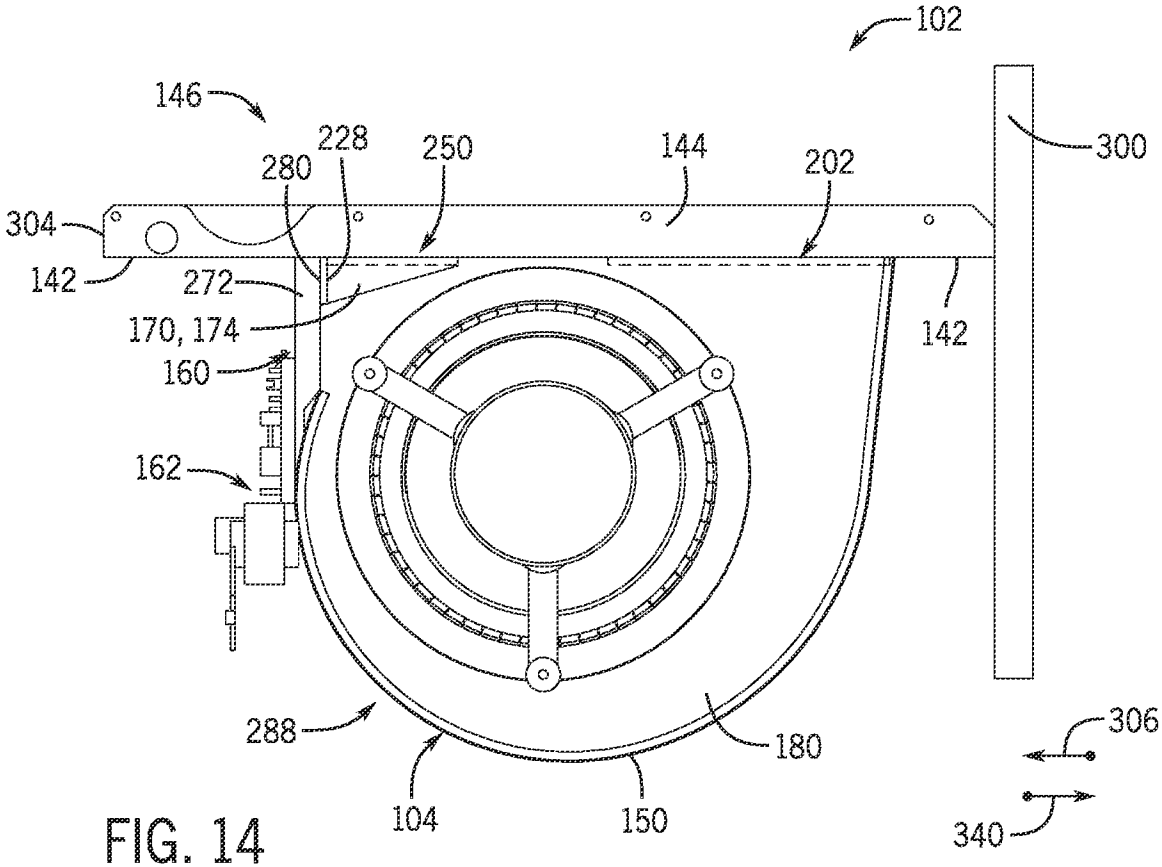
FIG. 14 is an elevation view of an embodiment of a blower assembly in an installed configuration, in accordance with an aspect of the present disclosure.
Figure 15:
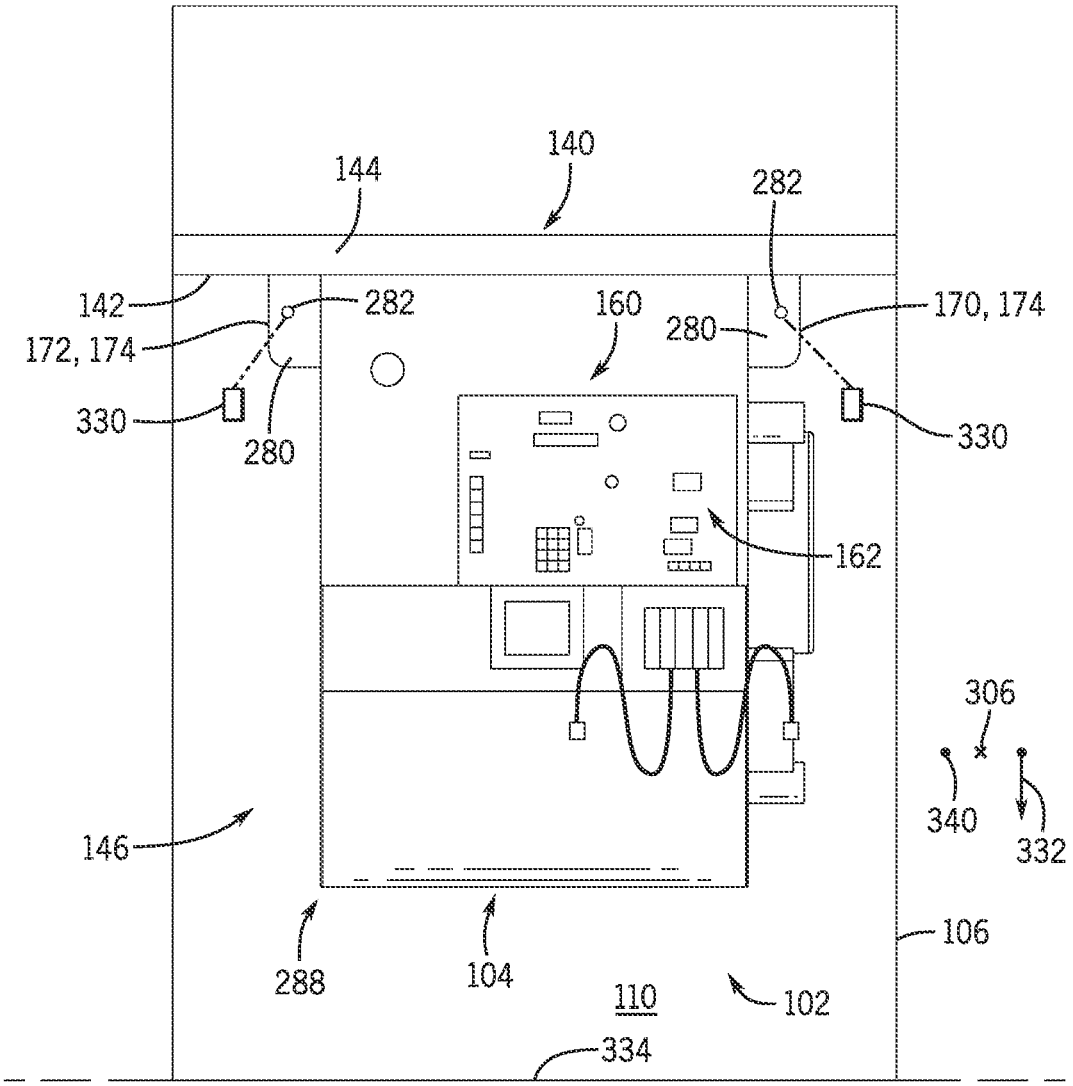
FIG. 15 is a front view of an embodiment of a blower assembly in an installed configuration, in accordance with an aspect of the present disclosure.

To better illustrate the engagement between the tabs 280 and the abutment tabs 280, FIG. 14 is an elevation view of an embodiment of the blower assembly 102 in which the blower 104 is in the installed configuration 146 on the blower shelf 140. FIG. 15 is a front view of an embodiment of the blower assembly 102 in which the blower 104 in the installed configuration 146. That is, in FIGS. 14 and 15, the blower sub-assembly 288 is in an installed configuration with the blower shelf 140. FIGS. 14 and 15 will be discussed concurrently below. In the installed configuration 146 of the blower 104, the engagement between the flanges 190 of the blower housing 150 and the primary and secondary support channels 202, 250 may position the blower sub-assembly 288 such that the apertures 282 formed in the tabs 280 of the control mounting panel 160 are aligned with the apertures 234 formed in the abutment tabs 228 of the guide brackets 174. Suitable fasteners 330 (e.g., screws) may thus extend through the apertures 234, 282 and couple the tabs 280 to the abutment tabs 228. In this manner, the fasteners 330 may be used to fixedly couple the blower sub-assembly 288 to the guide brackets 174 of the blower shelf 140 to temporarily block translational movement of the blower sub-assembly 288 relative to the blower shelf 140.

In some embodiments, the blower shelf 140 may be positioned in the enclosure 106 such that the blower sub-assembly 288 is positioned vertically beneath (with respect to a direction of gravity 332) the blower shelf 140 in the installed configuration 146 of the blower 104. In such embodiments, the engagement between the flanges 190 of the blower housing 150 and the primary and secondary support channels 202, 250 may support substantially all of or all of a weight of the blower sub-assembly 288 and may thus suspend the blower sub-assembly 288 above a lower surface 334 of the enclosure 106, for example. Accordingly, it should be understood that, in such embodiments, the fasteners 330 may support a fractional or negligible portion of the weight of the blower sub-assembly 288.

It should be appreciated that, based on the engagement between the flanges 190 of the blower housing 150 and the primary and secondary support channels 202, 250, the blower sub-assembly 288 may be positioned in the enclosure 106 such that, in the installed configuration 146, the fasteners 330 are located near a region of the enclosure 106 that provides ample access to the fasteners 330 by a user (e.g., the fasteners 330 may be located in a region of the enclosure 106 that is close to or facing the opening 110 and/or close to or facing the door 108). As such, the blower assembly 102 may facilitate access and removal/installation of the fasteners 330 by the user. Moreover, the fasteners 330 may be sufficient to retain the blower assembly 102 in the installed configuration 146, such that a quantity of fasteners 330 engaged or removed from the blower assembly 102 when transitioning the blower assembly 102 between the assembled and disassembled configurations may be relatively low (e.g., two or less). Further, in certain embodiments, one of the fasteners 330 may be omitted from the blower assembly 102, such that a single fastener 330 is sufficient to retain the blower sub-assembly 288 in an engaged configuration with the blower shelf 140. It should be understood that, in such embodiments, a corresponding one of the tabs 280 may be omitted from the control mounting panel 160, for example.

To transition the blower 104 from the installed configuration 146 to the uninstalled configuration 148, the user may perform the aforementioned steps in reverse order. That is, the user may remove the fasteners 330 to decouple the tabs 280 from the abutment tabs 228, and may subsequently translate the blower sub-assembly 288 in a second sliding direction 340, opposite the first sliding direction 306, to disengage the flanges 190 of the blower housing 150 from the primary and secondary support channels 202, 250.

Figure 16:
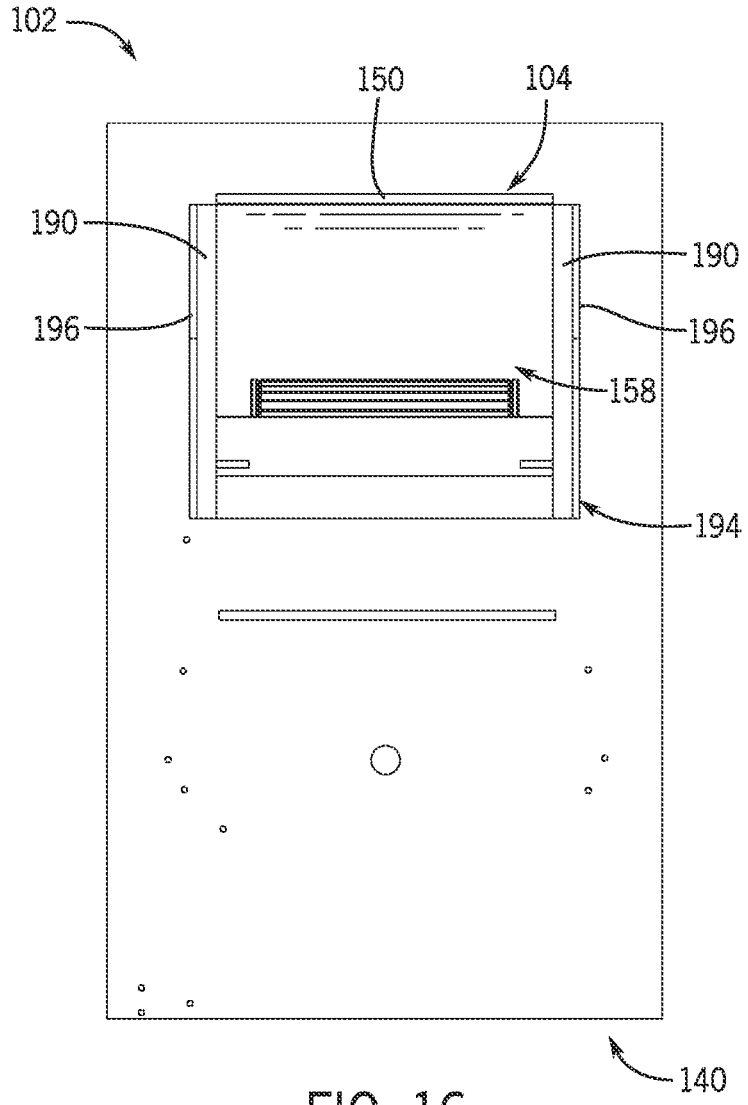
FIG. 16 is a top view of an embodiment of a blower assembly in an installed configuration, in accordance with an aspect of the present disclosure.

FIG. 16 is an elevation view of an embodiment of the blower assembly 102, in which the blower 104 is in the installed configuration 146 with the blower shelf 140. As shown in the illustrated embodiment, in the installed configuration 146, the outlet port 158 of the blower 104 may be aligned with the outlet opening 194 of the blower shelf 140. Moreover, in embodiments in which the blower shelf 140 is configured to suspend the blower 104 within the enclosure 106, the flanges 190 of the blower housing 150 may be positioned vertically above (e.g., with respect to the direction of gravity 332) and may rest on the ledges 196 of the blower shelf 140.

Figure 17:
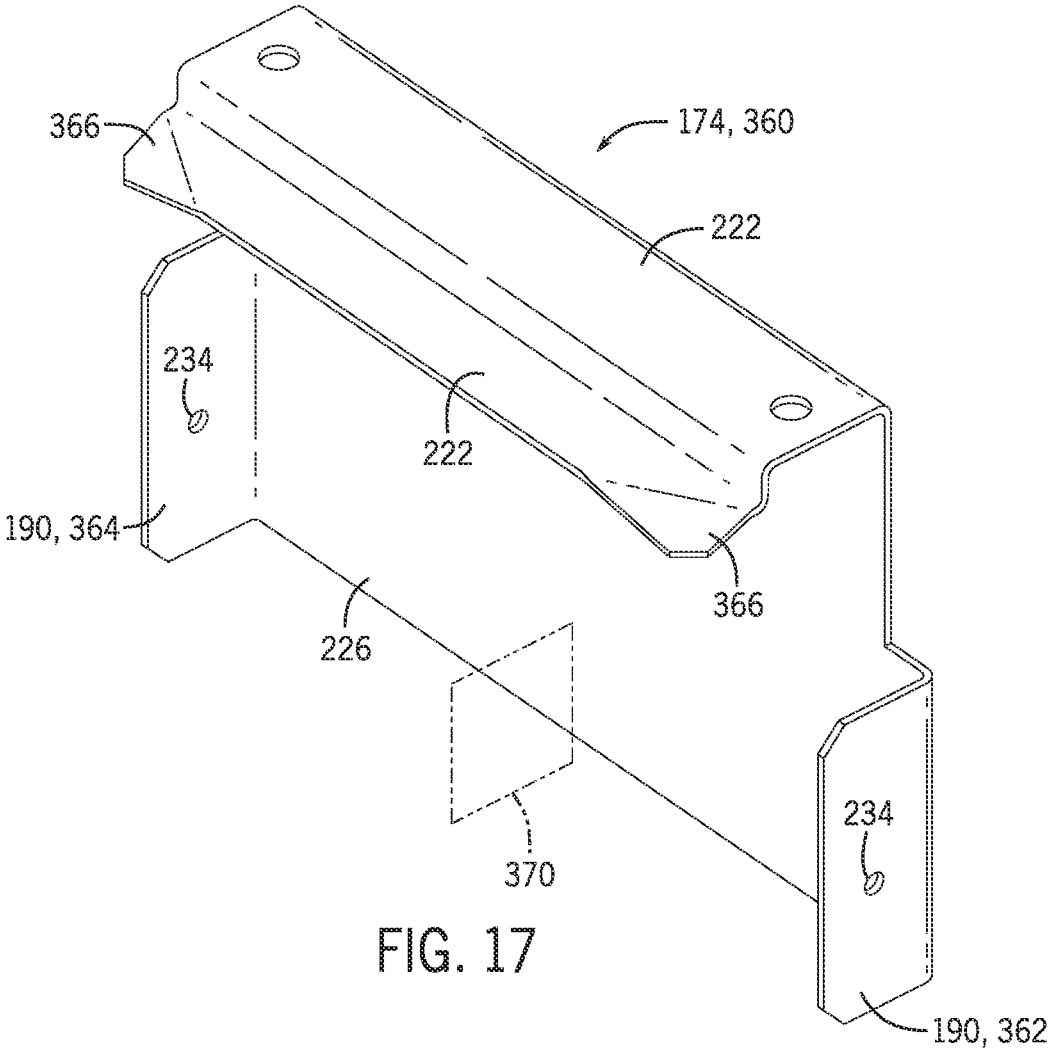
FIG. 17 is a perspective view of an embodiment of a guide bracket of a blower assembly, in accordance with an aspect of the present disclosure.

FIG. 17 is a perspective view of another embodiment of one of the guide brackets 174, referred to herein as a guide bracket 360. In the illustrated embodiment, the guide bracket 360 includes a pair of abutment tabs 228, namely a first abutment tab 362 and a second abutment tab 364, that extend from the side flange 226. The guide flanges 222 includes a set of angled portions 366 (e.g., bent portions) located near distal ends of the guide flanges 222. The angled portions 366 may facilitate guiding the correspond flange 190 of the blower housing 150 into the corresponding secondary support channel 250 during installation of the blower 104 with the blower shelf 140. In some embodiments, the guide bracket 360 may be substantially self-similar or symmetric about a central plane 370 that divides (e.g., bisects) the guide bracket 360. As a result, the guide bracket 360 may be used to facilitate supporting the blower sub-assembly 288 on (e.g., against, with) the blower shelf 140 in accordance with the aforementioned techniques irrespectively of whether the guide bracket 360 is used in place of the first guide bracket 170 or the second guide bracket 172. That is, a pair of the guide brackets 360 (e.g., self-similar guide brackets) may be used in lieu of the first guide bracket 170 and the second guide bracket 172 in certain embodiments of the blower assembly 102, while the blower assembly 102 may nonetheless be operable in accordance with the techniques set forth above.

Figure 18:
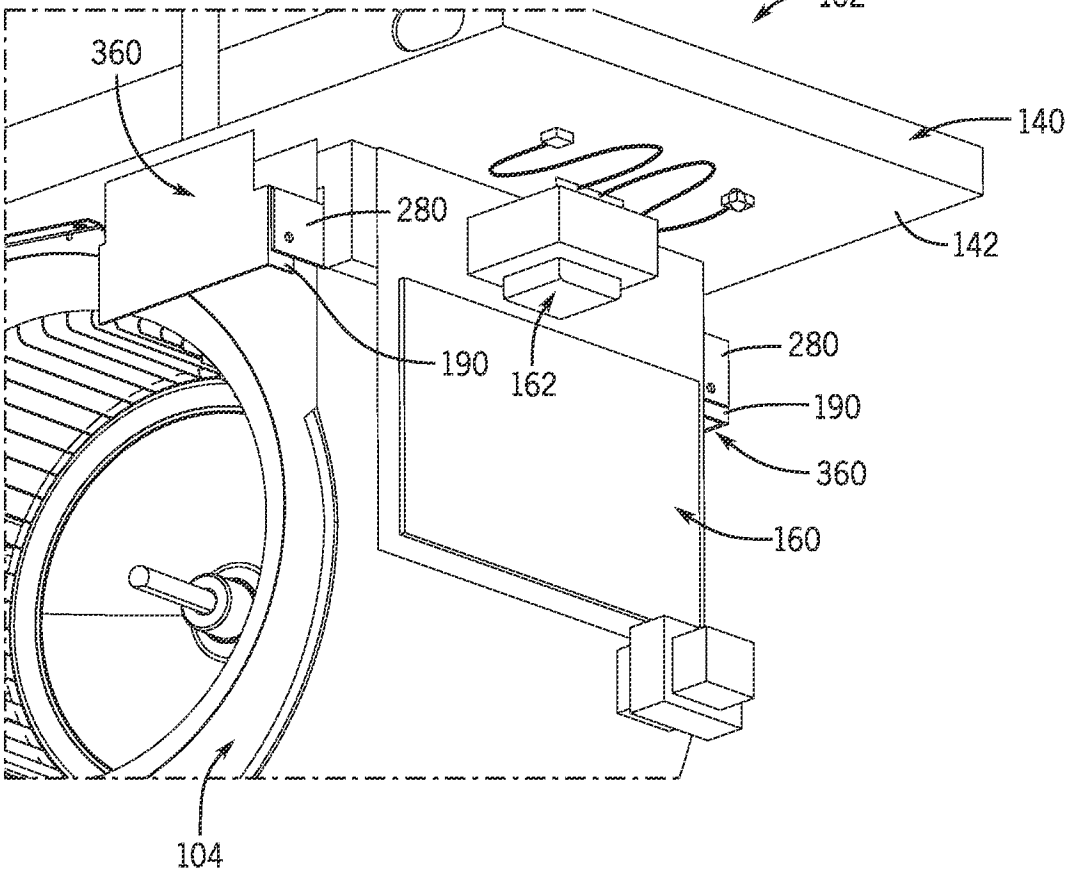
FIG. 18 is a perspective view of an embodiment of a portion of a blower assembly in an installed configuration, in accordance with an aspect of the present disclosure.

For example, FIG. 18 is a perspective view of an embodiment of a portion of the blower assembly 102 including a pair of the guide brackets 360. In particular, the illustrated embodiment of the blower assembly 102 includes a first guide bracket 360 configured to engage with a first tab 280 of the control mounting panel 160 in accordance with the aforementioned techniques, and a second guide bracket 360 configured to engage with a second tab 280 of the control mounting panel 160 in accordance with the aforementioned techniques.

Figure 19:
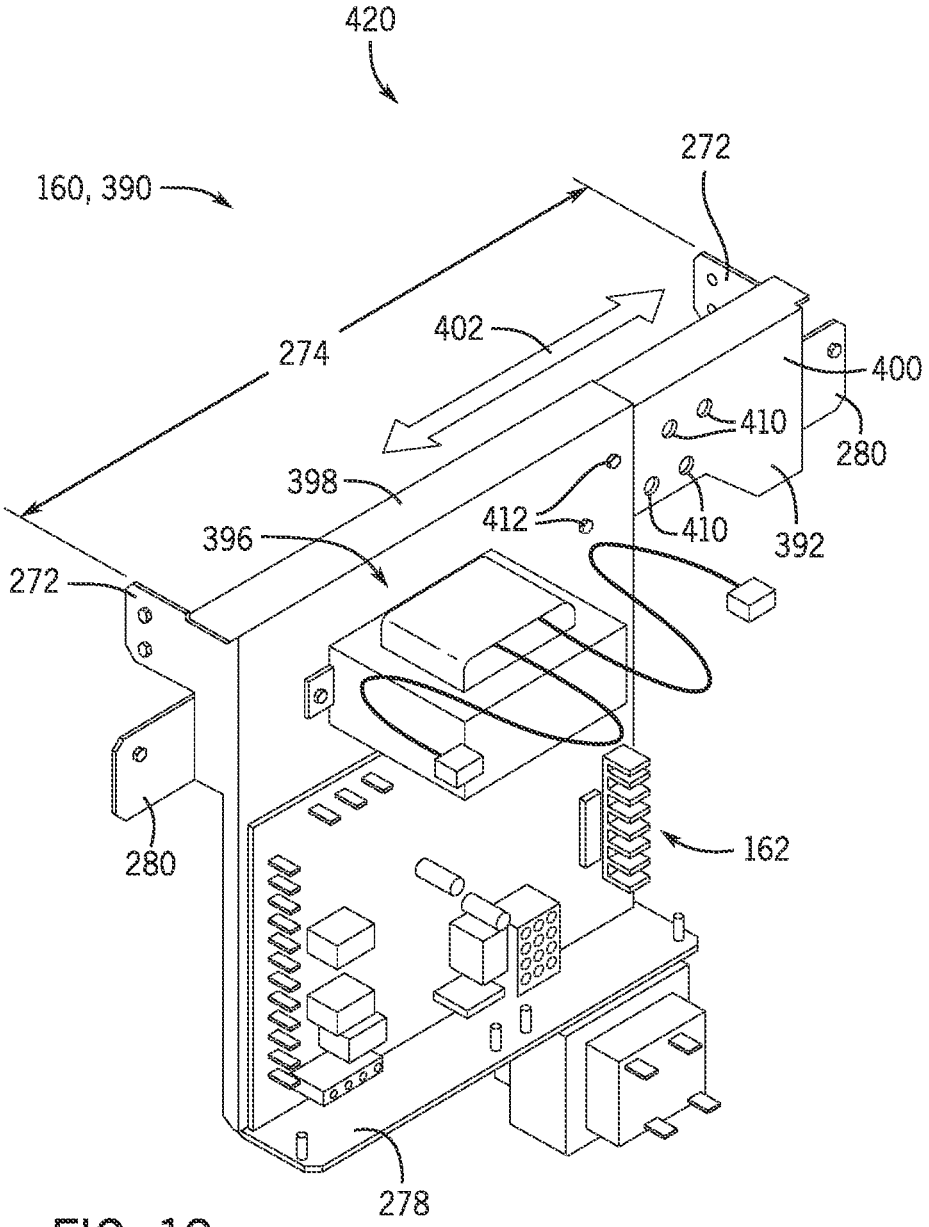
FIG. 19 is a perspective view of an embodiment of a control mounting panel of a blower assembly in an expanded configuration, in accordance with an aspect of the present disclosure.

FIG. 19 is a perspective view of an embodiment of the control mounting panel 160, referred to herein as a control mounting panel 390, that includes an arm portion 392 (e.g., an adjustable arm) configured to enable adjustment of the width dimension 274 of the control mounting panel 390. For example, in some embodiments, one of the attachment flanges 272 and/or one of the tabs 280 may be coupled to the arm portion 392. The arm portion 392 may be a component that is separate from a chassis portion 396 of the control mounting panel 390. The arm portion 392 may be configured to engage with and translate relative to the chassis portion 396 to enable adjustment of the width dimension 274 between the attachment flanges 272 and/or the tabs 280. For example, in some embodiments, the chassis portion 396 of the control mounting panel 390 may include a receiving section 398 (e.g., a channel, a passage, a rail, a slot, etc.) that is configured to receive (e.g., engage with) a body portion 400 of the arm portion 392. The engagement between the receiving section 398 and the body portion 400 enables the arm portion 392 to translate relative to the chassis portion 396 along sliding directions 402, either toward or away from the chassis portion 396. To this end, the arm portion 392 may be set at a particular position that achieves a desired magnitude of the width dimension 274. That is, the arm portion 392 may be positioned to achieve a magnitude of the width dimension 274 that is substantially equal to or marginally greater than the width 210 of the blower housing 150. As such, the control mounting panel 390 may be coupled to a variety of different sizes of blower housing 150, such as a relatively large blower housing 150 or a relatively small blower housing 150.

Figure 20:
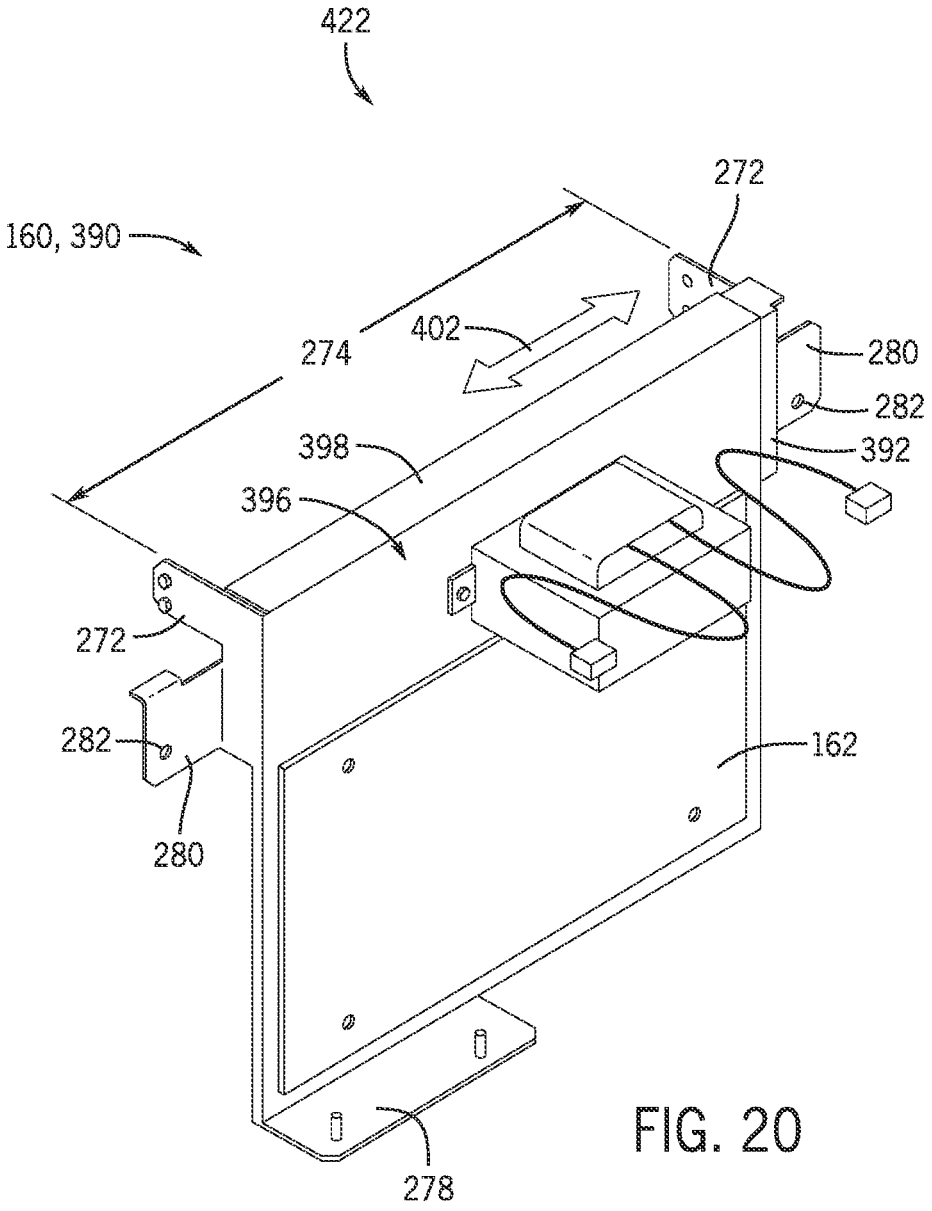
FIG. 20 is a perspective view of an embodiment of a control mounting panel of a blower assembly in a retracted configuration, in accordance with an aspect of the present disclosure.

In some embodiments, a plurality of apertures 410 may be formed in the body portion 400 of the arm portion 392. Fasteners 412 may be configured to extend into certain of the apertures 410 to couple the arm portion 392 to the chassis portion 396 at a plurality of discrete positions. In some embodiments, each of the discrete positions may correspond to a particular size of blower housing 150. For example, a first set of the apertures 410 may be formed in the body portion 400 such that, upon extension of the fasteners 412 into these apertures 410, the arm portion 392 is positioned such that the width dimension 274 accommodates an embodiment of the blower 104 having a relatively large blower housing 150. Further, a second set of the apertures 410 may be formed in the body portion 400 such that, upon extension of the fasteners 412 into these apertures 410, the arm portion 392 is positioned such that the width dimension 274 accommodates an embodiment of the blower 104 having a relatively small blower housing 150. In the illustrated embodiment of FIG. 19, the control mounting panel 390 is in an expanded configuration 420, in which the arm portion 392 is positioned such that the width dimension 274 is relatively large. FIG. 20 is perspective view of an embodiment of the control mounting panel 390 in which the control mounting panel 390 is in a retracted configuration 422. In the retracted configuration 422, the arm portion 392 may be positioned such that the width dimension 274 is relatively small (e.g., as compared to the width dimension 274 in the expanded configuration 420 of the control mounting panel 390).

As set forth above, embodiments of the present disclosure may provide one or more technical effects useful for facilitating installation, removal, maintenance, inspection, and/or replacement of a blower disposed within an enclosure without disassembly and/or removal of other HVAC system components adjacent to the blower. Moreover, the blower assembly disclosed herein enables removal of control circuitry of the blower together with a housing of the blower, without involving separate removal of the control circuitry independent of the housing, which may expedite and reduce a complexity of removal of the blower and the control circuitry from the HVAC system. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A blower assembly, comprising:

a blower shelf comprising a first support channel;

a guide bracket coupled to the blower shelf to form a second support channel;

a blower housing comprising a flange configured to extend into the first support channel and the second support channel; and a control mounting panel configured to couple to the blower housing and comprising a tab extending therefrom, wherein the flange of the blower housing is configured to engage with the first support channel and the second support channel during transition of the blower housing along a first direction and into an installed configuration of the blower housing and during transition of the blower housing along a second direction, opposite the first direction, and into an uninstalled configuration of the blower housing, wherein the tab abuts the guide bracket in the installed configuration, and wherein the blower housing comprises an outlet port, the blower shelf comprises an outlet opening, and the outlet port is configured to align with the outlet opening in the installed configuration of the blower housing.

2. The blower assembly of claim 1, wherein the guide bracket comprises a guide flange, and the second support channel is formed between a first surface of the guide flange and a second surface of the blower shelf.

3. The blower assembly of claim 1, comprising:

a blower motor mounted to the blower housing; and control circuitry of the blower motor, wherein the control circuitry is coupled to the control mounting panel.

4. The blower assembly of claim 1, wherein the blower shelf comprises a sliding surface, the blower housing is configured to translate along the sliding surface in the first direction and in the second direction, the guide bracket comprises an abutment tab extending cross-wise to the sliding surface, and the tab of the control mounting panel abuts the abutment tab in the installed configuration of the blower housing.

5. The blower assembly of claim 1, wherein the control mounting panel comprises a first attachment flange configured to couple to a first side wall of the blower housing and a second attachment flange configured to couple to a second side wall of the blower housing.

6. The blower assembly of claim 5, wherein the control mounting panel comprises:

a chassis portion comprising the first attachment flange; and an arm portion configured to moveably engage with the chassis portion and comprising the second attachment flange, wherein the arm portion is configured to translate relative to the chassis portion to adjust a width dimension between the first attachment flange and the second attachment flange.

7. The blower assembly of claim 6, comprising a plurality of fastener apertures formed in the arm portion and configured to receive fasteners to couple the arm portion to the chassis portion at a plurality of discrete positions.

8. The blower assembly of claim 1, wherein, in the installed configuration of the blower housing, the first support channel and the second support channel are configured to suspend the blower housing and the control housing panel from the blower shelf.

9. The blower assembly of claim 1, comprising a fan wheel disposed within the blower housing, wherein the fan wheel is configured to direct an air flow through the outlet port and the outlet opening in the installed configuration of the blower housing.

10. A blower assembly for a heating, ventilation, and air conditioning (HVAC) system, the blower assembly comprising:

a blower shelf comprising ledges forming first support channels;

guide brackets coupled to the blower shelf to form second support channels between a surface of the blower shelf and respective first flanges of the guide brackets; and a blower sub-assembly comprising a blower housing and a control mounting panel configured to support control circuitry of a blower, wherein the blower housing comprises second flanges configured to engage with the first support channels and the second support channels, wherein the second flanges are configured to translate along the first support channels and the second support channels in a first direction during installation of the blower sub-assembly with the blower shelf, wherein the control mounting panel is configured to be secured to the guide brackets in an installed configuration of the blower sub-assembly, and wherein the guide brackets remain stationary with respect to the blower shelf during transition of the blower sub-assembly between the installed configuration and an uninstalled configuration of the blower sub-assembly.

11. The blower assembly of claim 10, wherein the second flanges are configured to translate along the first support channels and the second support channels in a second direction, opposite the first direction, to transition the blower sub-assembly to the uninstalled configuration.

12. The blower assembly of claim 10, wherein the control mounting panel comprises tabs extending therefrom, wherein the guide brackets comprise abutment tabs, and wherein the tabs are configured to abut the abutment tabs in the installed configuration of the blower sub-assembly.

13. The blower assembly of claim 10, wherein the guide brackets comprise a first guide bracket and a second guide bracket, wherein the first guide bracket and the second guide bracket are symmetrical.

14. The blower assembly of claim 10, comprising the control circuitry and a motor of the blower, wherein the motor is mounted to the blower housing, wherein the control circuitry is configured to control operation of the motor, and wherein the control circuitry is configured to translate with the blower housing during translation of the second flanges within the first support channels and the second support channels.

15. The blower assembly of claim 10, wherein the control mounting panel comprises a chassis portion having a first attachment flange and an arm portion having a second attachment flange, wherein the first attachment flange and the second attachment flange are configured to couple the control mounting panel to the blower housing, and wherein the arm portion is translatable relative to the chassis portion to enable adjustment of a width dimension between the first attachment flange and the second attachment flange.

16. The blower assembly of claim 10, wherein the blower housing comprises an outlet port, the blower shelf comprises an outlet opening formed therein, and the outlet port is configured to align with the outlet opening in the installed configuration of the blower sub-assembly with the blower shelf.

17. A heating, ventilation, and/or air conditioning (HVAC) system, comprising:

an enclosure configured to house a blower;

a blower shelf coupled to the enclosure, wherein the blower shelf comprises a first support channel and an outlet opening formed therein;

a guide bracket coupled to the blower shelf to form second support channel between the guide bracket and the blower shelf; and a blower sub-assembly, comprising:

a blower housing of the blower, wherein the blower housing comprises a flange extending therefrom and an outlet port formed therein; and a control mounting panel coupled to the blower housing and supporting control circuitry mounted to the control mounting panel, wherein the flange of the blower housing is configured to translate along the first support channel and the second support channel in a first direction to transition the blower sub-assembly to an installed configuration within the enclosure, wherein the flange of the blower housing is configured to translate along the first support channel and the second support channel in a second direction, opposite the first direction, to transition the blower sub-assembly to an uninstalled configuration, and wherein the outlet port is configured to align with the outlet opening in the installed configuration of the blower sub-assembly.

18. The HVAC system of claim 17, wherein the control mounting panel comprises a tab extending therefrom, wherein the tab is configured to abut and couple to the guide bracket in the installed configuration of the blower sub-assembly to block movement of the blower sub-assembly relative to the blower shelf.

19. The HVAC system of claim 17, wherein the guide bracket comprises a guide flange and the second support channel is formed between a first surface of the guide flange and a second surface of the blower shelf, wherein a dimension of the second support channel decreases along the first direction.

20. The HVAC system of claim 17, wherein, in the installed configuration of the blower sub-assembly, the first support channel and the second support channel are configured to receive the flange to suspend the blower sub-assembly within the enclosure and above a lower surface of the enclosure.

* * * * *